US010864757B2

(12) United States Patent
Sasaki et al.

(10) Patent No.: US 10,864,757 B2
(45) Date of Patent: Dec. 15, 2020

(54) MEDIUM TRANSPORTING APPARATUS AND RECORDING APPARATUS

(71) Applicant: SEIKO EPSON CORPORATION, Tokyo (JP)

(72) Inventors: Keisuke Sasaki, Matsumoto (JP); Takayuki Tanaka, Matsumoto (JP); Toshiki Shiroki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/434,477

(22) Filed: Jun. 7, 2019

(65) Prior Publication Data

US 2019/0375218 A1 Dec. 12, 2019

(30) Foreign Application Priority Data

Jun. 11, 2018 (JP) ..... 2018-110964

(51) Int. Cl.
*B41J 13/00* (2006.01)
*B41J 29/38* (2006.01)

(52) U.S. Cl.
CPC ..... *B41J 13/009* (2013.01); *B41J 29/38* (2013.01)

(58) Field of Classification Search
CPC ..... B41J 13/009
See application file for complete search history.

(56) References Cited

U.S. PATENT DOCUMENTS

2007/0048058 A1* 3/2007 Koga ..... B41J 13/0018 400/283
2017/0087877 A1* 3/2017 Nishimura ..... B41J 17/02
2017/0087895 A1* 3/2017 Arai ..... B41J 13/0018

FOREIGN PATENT DOCUMENTS

JP 2008-290782 A 12/2008

* cited by examiner

*Primary Examiner* — Julian D Huffman
(74) *Attorney, Agent, or Firm* — Workman Nydegger

(57) ABSTRACT

In a printer, a medium transporting apparatus includes a straight path through which a medium on which recording has been performed with the recording head is output, an inversion path through which the recording medium on which recording has been performed with the recording head is output to an output destination different from an output destination of the straight path, a switching member provided downstream of the recording head in a medium transport direction and configured to switch between a first state in which the switching member constitutes a portion of the straight path and a second state in which the switching member constitutes a portion of the inversion path, a motor that drives a pair of transport rollers that transports the medium, and a switching mechanism that switches between a first state and a second state with motive power of the motor.

12 Claims, 18 Drawing Sheets

MEDIUM TRANSPORTING APPARATUS AND RECORDING APPARATUS

The present application is based on, and claims priority from JP Application Serial Number 2018-110964, filed Jun. 11, 2018, the disclosure of which is hereby incorporated by reference herein in its entirety.

BACKGROUND

1. Technical Field

The present disclosure relates to a medium transporting apparatus that transports a medium, and a recording apparatus that performs recording on a medium transported with the medium transporting apparatus.

2. Related Art

There is a recording apparatus, a representative example of which is an ink jet printer, including a plurality of transport paths that have different transport destinations and that serve as transport paths that transport a medium after recording has been performed in a recording unit.

For example, there is a recording apparatus including an inversion path that outputs a medium after recording in a face-down manner in which a recording surface is faced downwards, and a straight path that outputs the medium in a face-up manner in which the recording surface is faced upwards. Specifically, in JP-A-2008-290782, the inversion path described above is denoted as an inversion sheet output path 65, and the straight path is denoted as a straight sheet output path 62.

A recording apparatus in JP-A-2008-290782 is configured to automatically switch a transport destination of a medium after recording. More specifically, the recording apparatus includes a switching mechanism that is situated downstream of a recording unit in a medium transport direction and that switches the transport destination of the medium after recording to either an inversion path and a straight path. When the medium is output to the straight path, an ejection tray constituting the straight path is configured to open automatically. Note that in JP-A-2008-290782, the switching mechanism described above is denoted as an output port switching mechanism 66, and the ejection tray described above is denoted as a straight sheet output tray 63.

Note that in JP-A-2008-290782, a solenoid is used as an example of a mechanism that automatically opens the ejection tray. Furthermore, the opening mechanism may include a drive source such as a motor dedicated for the ejection tray.

Since component prices of the solenoid, the motor, and other components are expensive, installment of a drive source dedicated for the ejection tray increases the manufacturing cost.

SUMMARY

A medium transporting apparatus of the disclosure that overcomes the issue described above is a medium transporting apparatus including a first transport path that outputs a medium that has been processed in a processing unit in which processing of the medium is performed; a second transport path that outputs the medium processed in the processing unit to an output destination that is different from an output destination of the first transport path; a switching member that is provided downstream of the processing unit in a medium transport direction and that is configured to switch between a first state in which the switching member constitutes a portion of a path surface of the first transport path, and a second state in which the switching member constitutes a portion of a path surface of the second transport path; a drive source that drives a transport unit that transports the medium; and a switching mechanism that switches the switching member between the first state and the second state with motive power of the drive source.

DESCRIPTION OF EXEMPLARY EMBODIMENTS

Figure 1:
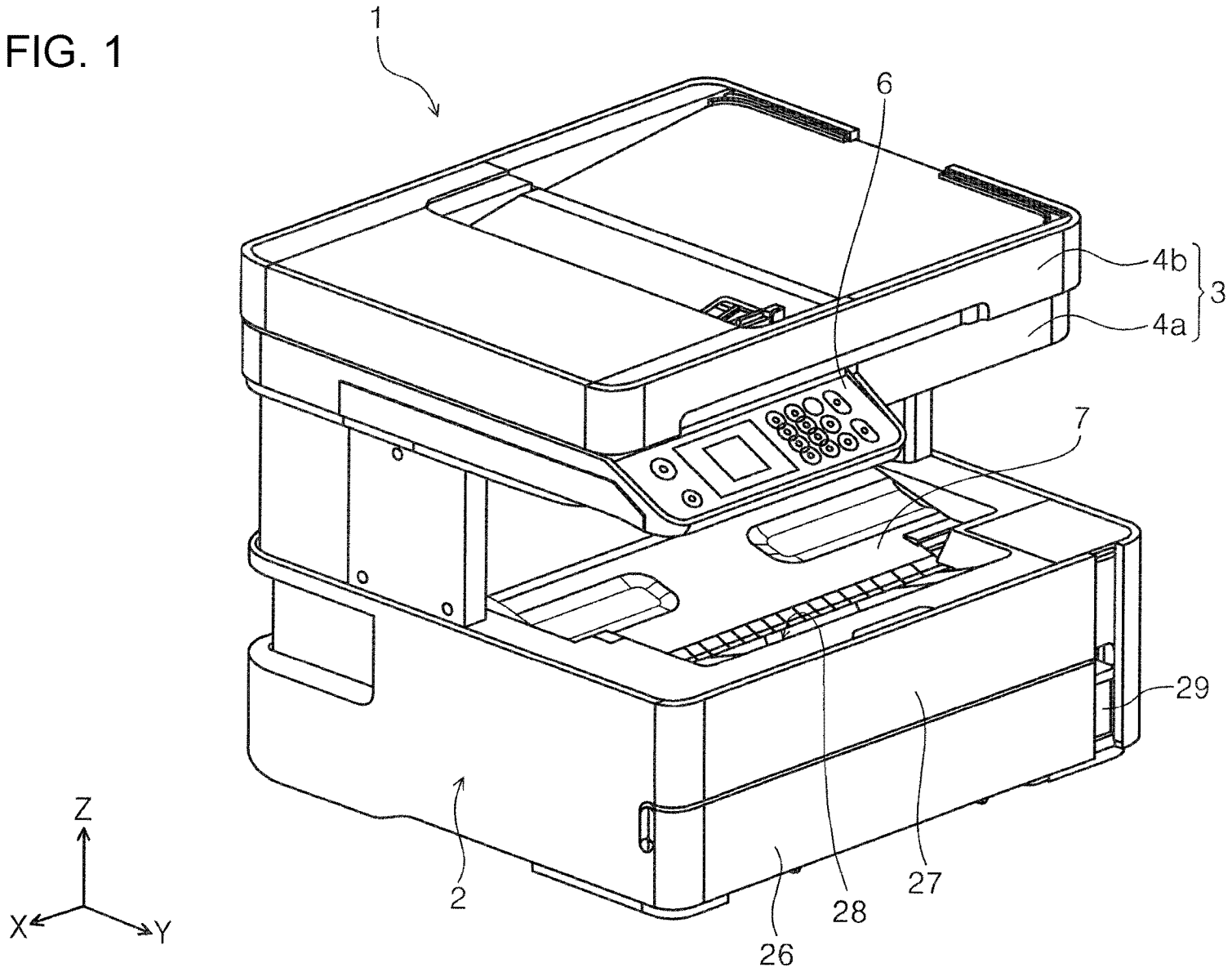
FIG. 1 is an external perspective view of a printer according to a first exemplary embodiment.

Hereinafter, an outline of the disclosure will be described.

A medium transporting apparatus according to a first aspect of the disclosure includes a first transport path that outputs a medium that has been processed in a processing unit in which processing of the medium is performed; a second transport path that outputs the medium processed in the processing unit to an output destination that is different from an output destination of the first transport path; a switching member that is provided downstream of the processing unit in a medium transport direction and that is configured to switch between a first state in which the switching member constitutes a portion of a path surface of the first transport path, and a second state in which the switching member constitutes a portion of a path surface of the second transport path; a drive source that drives a transport unit that transports the medium; and a switching mechanism that switches the switching member between the first state and the second state with motive power of the drive source, in which by switching between the first state and the second state, switching between the first transport path and the second transport path is performed.

According to the present aspect, since the switching mechanism that switches the switching member between the first state and the second state with the motive power of the drive source of the transport unit is included, the switching member that switches the transport destination of the medium after recording between the first transport path and the second transport path can be operated with the motive power of the drive source. Accordingly, a dedicated drive source for driving the switching member can be omitted, and the medium transporting apparatus can be manufactured at a low cost.

A second aspect of the disclosure according to the first aspect further includes a carriage including the processing unit, the carriage being configured to move in a width direction intersecting the medium transport direction, in which the switching between the first state and the second state performed with the switching mechanism is configured to be switched by setting the switching mechanism to a transmitting state in which the motive power is transmitted to the switching member and to a non-transmitting state in which the motive power is not transmitted to the switching member, and the switching of the switching mechanism between the transmitting state and the non-transmitting state is performed by a moving operation of the carriage.

According to the present aspect, since the switching between the first state and the second state performed with the switching mechanism is configured to switch between the transmitting state in which the motive power is transmitted to the switching member and the non-transmitting state in which the motive power is not transmitted to the switching member, the switching mechanism can be set to the non-transmitting state except when the switching member is switched; accordingly, the switching member can be prevented from operating unexpectedly. Furthermore, since the switching of the switching mechanism between the transmitting state and the non-transmitting state is performed with the moving operation of the carriage, the switching of the switching mechanism between the transmitting state and the non-transmitting state can be performed with a simple configuration.

In a third aspect of the disclosure according to the second aspect, the switching member includes a pivot shaft in a portion upstream thereof in the medium transport direction, and swings a portion downstream thereof as a free end to switch between the first state and the second state, the transport unit is a pair of transport rollers that are provided downstream of the processing unit and that include a driving roller that is rotationally driven by the motive power of the of the drive source and a driven roller that is rotated and driven by a rotation of the driving roller, the switching mechanism includes a first gear provided coaxially with a rotation shaft of the driving roller, a second gear provided coaxially with the pivot shaft of the switching member, and at least one intermediate gear that transmits the motive power from the first gear to the second gear, and the first gear is configured to move in the width direction between a first position in which the first gear meshes with the intermediate gear and sets the switching mechanism to the transmitting state, and a second position in which the first gear separates from the intermediate gear and sets the switching mechanism to the non-transmitting state.

According to the present aspect, a configuration can be provided in which the switching mechanism is configured to switch the switching member between the first state and the second state with the motive power of the drive source.

In a fourth aspect of the disclosure according to the third aspect the switching mechanism includes a pressing unit that presses the first gear from the first position towards the second position, and an abutment portion that is provided coaxially with a rotation shaft of the first gear and that is configured to be displaced between an advanced position in which the abutment portion is advanced into a movement area of the carriage, and a retracted position in which the abutment portion is retracted from the movement area of the carriage. In a state in which the carriage is in contact with the abutment portion in the advanced position, when the carriage is moved in a direction separating from a home position, the first gear moves from the second position to the first position, and in a state in which the carriage is in contact with the abutment portion in the advanced position, when the carriage moves in a direction approaching the home position, the first gear moves from the first position to the second position.

According to the present aspect, the switching mechanism includes a pressing unit that presses the first gear from the first position towards the second position, and an abutment portion that is provided coaxially with a rotation shaft of the first gear and that is configured to be displaced between an advanced position in which the abutment portion is advanced into a movement area of the carriage, and a retracted position in which the abutment portion is retracted from the movement area of the carriage, and in a state in which the carriage is in contact with the abutment portion in the advanced position, when the carriage is moved in a direction separating from a home position, the first gear moves from the second position to the first position, and in a state in which the carriage is in contact with the abutment portion in the advanced position, when the carriage moves in a direction approaching the home position, the first gear moves from the first position to the second position; accordingly, switching of the switching mechanism between the transmitting state and the non-transmitting state can be performed with a simple configuration.

In a fifth aspect of the disclosure according to the third or fourth aspects, the intermediate gear includes a friction clutch mechanism that idles when a torque exceeding a predetermined value is applied.

According to the present aspect, since the intermediate gear includes the friction clutch mechanism that idles when a torque exceeding a predetermined value is applied, when a torque equivalent to or larger than the predetermined value is applied to the gear by, for example, the user manually moving the switching member, the friction clutch mechanism idles and the risk of the gears that constitute the switching mechanism being broken can be reduced.

In a sixth aspect of the disclosure according to any one of the first aspect to the fifth aspect, the first transport path is a non-inversion path that outputs the medium without inverting a bearing of the first surface that opposes the processing unit, and the second transport path is an inversion path that outputs the medium after inverting the bearing of the first surface.

According to the present aspect, in the medium transporting apparatus, since the first transport path is the non-inversion path that outputs the medium without inverting the bearing of the first surface that opposes the processing unit, and the second transport path is the inversion path that outputs the medium after inverting the bearing of the first surface, functions and effects similar to those of either one of the first to fifth aspects can be obtained.

A seventh aspect of the disclosure according to any one of the first to sixth aspects further includes a housing inside of which the processing unit is provided; and an opening/closing body provided in the housing, the opening/closing body configured to switch between a closed state that covers a first output unit that is an outlet of the medium transported through the first transport path, and an open state in which the first output unit is exposed with respect to the closed state; and an interlocking mechanism configured to switch the opening/closing body from the closed state to the open state in conjunction with the switching of the switching member from the second state to the first state.

According to the present aspect, since the housing is provided and since the opening/closing body configured to switch between the closed state that covers the first output unit that is the outlet of the medium transported through the first transport path, and the open state in which the first output unit is exposed is included, when the medium is not output through the first transport path, the opening/closing body can be in a closed state and entering of dust into the housing can be suppressed.

Furthermore, since the interlocking mechanism configured to switch the opening/closing body from the closed state to the open state in conjunction with the switching of the switching member from the second state to the first state is included, when the medium transported through the first transport path is output, the first output unit can be reliably exposed and the medium can be readily output.

An eighth aspect of the disclosure according to any one of the first to seventh aspects further includes a detection unit that detects a state of the switching member.

According to the present aspect, since the detection unit that detects the state of the switching member is included, the switched state of the switching member can be understood automatically.

A recording apparatus according to a ninth aspect of the disclosure includes a recording unit that performs a recording process on the medium; and the medium transporting apparatus according to any one of the first to eighth aspects, the medium transporting apparatus transporting the medium processed in the recording unit serving as the processing unit.

According to the present aspect, the recording apparatus including the recording unit that performs a recording process on the medium, and the medium transporting apparatus transporting the medium processed in the recording unit serving as the processing unit can obtain functions and effects that are similar to those in either one of the first to eighth aspect.

A tenth aspect of the disclosure according to the ninth aspect further includes a control unit that controls a state switching operation of the switching member, in which the control unit switches a state of the switching member according to a type or a size of the medium that is to be transported.

According to the present aspect, the control unit switches the state of the switching member according to the type or the size of the medium that is to be transported and the transport path through which the medium passes when output can be selected. For example, when the first transport path is the non-inversion path that outputs the medium without inverting the bearing of the first surface that opposes the processing unit, and the second transport path is the inversion path that outputs the medium after inverting the bearing of the first surface, a medium with high rigidity, such as thick paper or coated paper for photographs, is easily jammed in the second transport path that is the inversion path. Accordingly, when the transported medium is a medium with a high rigidity, by controlling the switching member so that the medium is output through the first transport path that is the non-inversion path, occurrence of jamming of the medium during outputting can be reduced.

A eleventh aspect of the disclosure according to the ninth aspect further includes a control unit that controls a state switching operation of the switching member, in which the recording unit is configured to perform recording by ejecting liquid on the medium, and the control unit switches a state of the switching member according to a liquid ejection volume per unit area on the medium ejected by the recording unit.

According to the present aspect, by switching the state of the switching member according to the liquid ejection volume per unit area on the medium ejected by the recording unit, the control unit can select the transport path through which the medium passes when being output.

When the liquid ejection volume per unit area on the medium ejected by the recording unit is large, the medium after the recording may become wet and the rigidity of the medium may be lowered. In some cases, a medium with low rigidity is easily jammed in the curved inversion path.

For example, when the first transport path is the non-inversion path that outputs the medium without inverting the bearing of the first surface that opposes the processing unit, and the second transport path is the inversion path that outputs the medium after inverting the bearing of the first surface, by controlling the switching member so that the medium in which the liquid ejection volume per unit area on the medium is equivalent to or larger than the predetermined amount is passed and is output through the first transport path that is the non-inversion path, the risk of jamming of the medium occurring during the output can be reduced.

A twelfth aspect of the disclosure according to the ninth aspect further includes a control unit that controls a state switching operation of the switching member, in which in the first state, the switching member is configured to expose a portion of the second transport path, and when a jamming of the medium occurs in the second transport path, the control unit sets the switching member to the first state.

According to the present aspect, when in the first state, the switching member is configured to expose a portion of the second transport path, and when a jamming of the medium occurs in the second transport path, the control unit sets the switching member to the first state; accordingly, the removal process of the sheet jamming that has occurred in the second transport path can be performed readily.

Hereinafter, the disclosure will be described in detail.

First Exemplary Embodiment

An outline of a recording apparatus according to an exemplary embodiment of the disclosure will be described with reference to the drawings. An ink jet printer 1 (hereinafter, merely referred to as a printer 1) is given as an example of the recording apparatus of the present exemplary embodiment. Note that the recording apparatus according to the disclosure is not limited to an ink jet printer and can also be configured as a laser printer, for example.

In the X-Y-Z coordinate system depicted in each of the drawings, which will be referred to, the X-axis direction is a width direction of a medium and indicates a width direction of the apparatus, the Y-axis direction is a medium transport direction in a medium transport path inside the recording apparatus and indicates a depth direction of the apparatus, and the Z-axis direction indicates a height direction of the apparatus. Furthermore, the direction in which the medium is transported is referred to as downstream, and the opposite direction is referred to as upstream.

Outline of Printer

Figure 2:
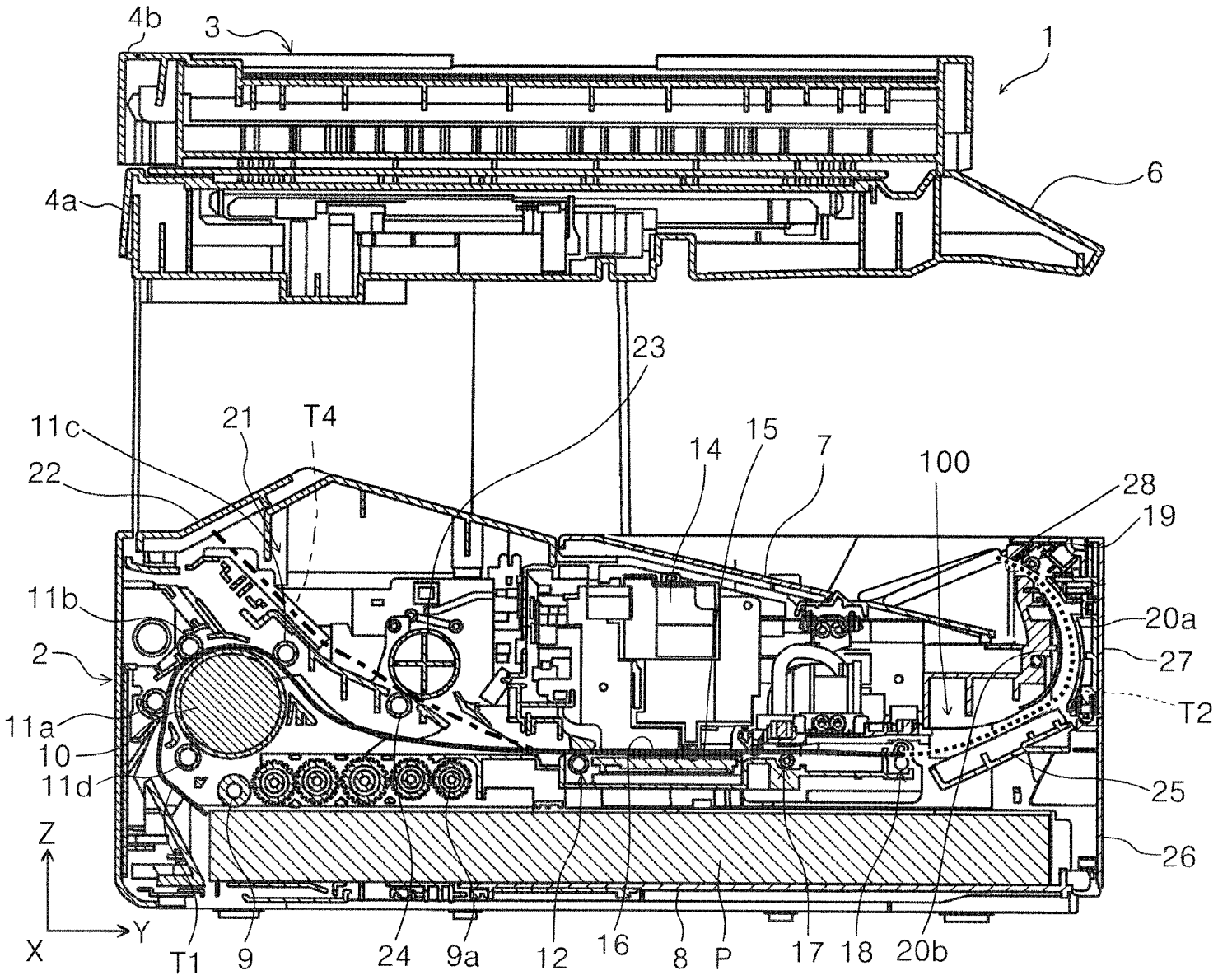
FIG. 2 is a sectional side view illustrating transport paths of a medium in the printer according to the first exemplary embodiment.

Referring to FIGS. 1 and 2, an overall configuration of the printer 1 will be described. The printer 1 includes a recording head 15 serving as a "recording unit" that performs a recording process on a medium P, and a medium transporting apparatus 100 that transports the medium P on which processing is performed with the recording head 15. Note that the recording head 15 and the medium transporting apparatus 100 are illustrated in FIG. 2.

In the present exemplary embodiment, the recording head 15 is a "processing unit" that performs a process on the medium P.

The printer 1 includes a scanner unit 3 provided above a housing 2 including the recording head 15 therein and is configured as a multifunction machine having a scanner function in addition to a printing function.

The recording head 15 is configured to perform recording with an ink jet system that ejects ink serving as "liquid" to the medium P. In the printer 1, the medium P on which recording is performed includes, for example, in addition to plain paper, postcards, business cards, cardboard thicker than plain paper, thin paper thinner than plain paper, and glossy paper for photographs.

The scanner unit 3 includes a scanner main body 4*a* and an auto feeder 4*b* that feeds an original document to a reading unit (not shown). An operation unit 6 is provided in an end portion of the scanner main body 4*a* on the Y direction side. The operation unit 6 includes a plurality of operation buttons and a display panel. In the present exemplary embodiment, the operation unit 6 is capable of implementing the printing operation of the printer 1 and the image reading operation of the scanner unit 3.

In the printer 1, the medium P on which recording has been performed with the recording head 15 inside the housing 2 is transported by the medium transporting apparatus 100 and is output from either a first output unit 13 serving as one of the output destinations and a second output unit 28 that is provided in an upper portion of the housing 2 illustrated in FIG. 1 and that serves as an output destination different from the first output unit 13. The first output unit 13 and the second output unit 28 are provided on a +Y side of the housing illustrated in FIG. 4.

A sheet output tray 7 on which a medium output from the second output unit 28 is stacked is provided in the upper portion of the housing 2. In the present exemplary embodiment, the sheet output tray 7 is configured to receive the medium, which has been output from the inside of the housing 2, in an inclined position.

Details of the medium transporting apparatus 100 will be described below after giving a description of the medium transport path of the printer 1.

Regarding Medium Transport Path of Printer Regarding Medium Transport Path from Medium Containing Unit A description will be given of a medium transport path from a medium containing unit 8 provided in a lower portion of the housing 2.

Figure 3:
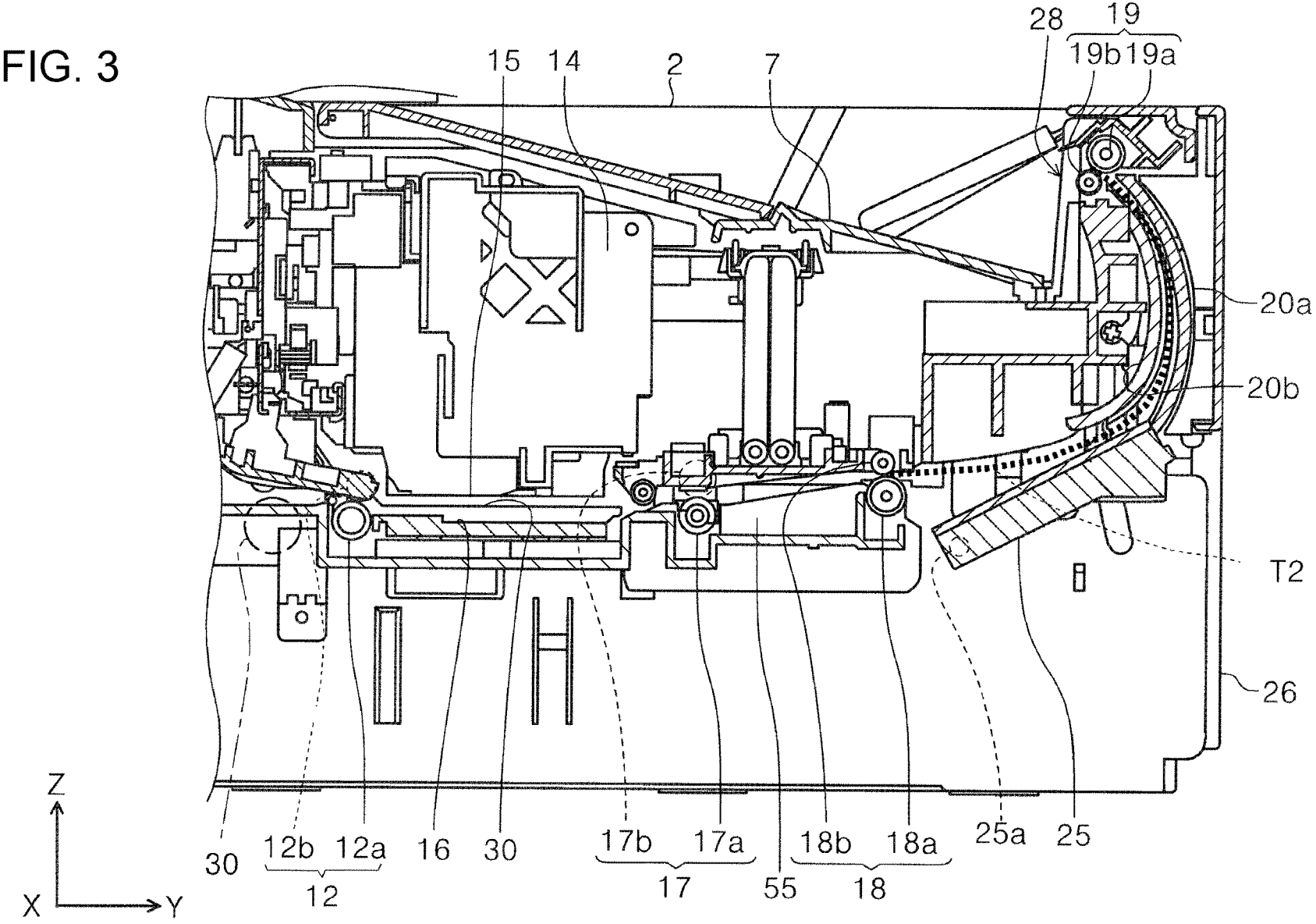
FIG. 3 is a sectional side view of the printer in which a switching member is in a second state.

Referring first to FIGS. 2 and 3, a description will be given of a medium transport path from the medium containing unit 8 to the second output unit 28 and, subsequently, a medium transport path from the medium containing unit 8 to the first output unit 13 will be described.

Note that in addition to feeding the medium P from the medium containing unit 8, the printer 1 is configured to feed the medium P from the back surface side feeding unit 21 provided on the back surface side of the apparatus. A description of sheet feeding from the back surface side feeding unit 21 will be described after describing the medium transport path from the medium containing unit 8 to the first output unit 13.

A solid line depicted in FIG. 2 with reference numeral T1 is a medium transport path from the medium containing unit 8 to a pair of first output rollers 18 described later. The broken line indicated by reference numeral T2 is a medium transport path from the pair of first output rollers 18 to the second output unit 28 and is an inversion path T2 serving as a "second transport path".

The medium containing unit 8 is provided at an end portion of the housing 2 on a −Z direction side which is a bottom portion of the housing 2 in FIG. 2. The medium containing unit 8 is configured to contain a plurality of media P. A pickup roller 9 is provided on the +Z direction side of the medium containing unit 8. The pickup roller 9 having a pivot shaft 9*a* as a fulcrum is configured to swing so as to come into contact with and separate from the medium P. By rotating while being in contact with the uppermost medium P accommodated in the medium containing unit 8, the pickup roller 9 transports the uppermost medium P downstream in the medium transport direction.

An inverting roller 10 and driven rollers 11*a*, 11*b*, 11*c*, and 11*d* that are disposed around the inverting roller 10 and that are driven and rotated by the inverting roller 10 are provided downstream of the pickup roller 9.

The medium P sent by the pickup roller 9 is inverted by the inverting roller 10 and is sent to a pair of feed rollers 12 provided downstream in the medium transport direction.

As illustrated in FIG. 3, the pair of feed rollers 12 include a feeding and driving roller 12*a*, and a feeding and driven roller 12*b* driven and rotated by the rotation of the feeding and driving roller 12*a*. The feeding and driving roller 12*a* is rotationally driven by a motor 30. The pair of feed rollers 12 send the medium P towards the recording head 15 disposed downstream in the medium transport direction. The drive of the motor 30 is controlled by a control unit 55.

In addition to the recording head 15, the medium transporting apparatus 100 includes a carriage 14 configured to move in a width direction that intersects the medium transport direction. The carriage 14 is configured to move in the X-axis direction, which serves as the width direction that intersects the Y-axis direction or the medium transport direction, with motive power of a drive source (not shown). In the present exemplary embodiment, a home position that is a stand-by position of the carriage 14 is provided on the −X side.

The recording head 15 is provided at a lower portion of the carriage 14 and ejects ink in the −Z direction from a nozzle (not shown).

The ink supplied to the recording head 15 is sent from an ink tank 29 (FIG. 1) provided on the +X-axis direction side in the housing 2 through a supply tube (not shown).

A medium supporting portion 16 is provided below the recording head 15, which is an area opposing the recording head 15. The medium supporting portion 16 supports an undersurface (a surface on the opposite side with respect to the recording surface) of the transported medium P.

The recording head 15 ejects ink onto the medium P supported by the medium supporting portion 16 and performs recording on a recording surface of the medium P.

A pair of transport rollers 17 serving as a "transport unit" that transports the medium are provided downstream of the recording head 15 in the medium transport direction. As illustrated in FIG. 3, the pair of transport rollers 17 include a driving roller 17*a* that is rotationally driven by the motor 30 serving as a "drive source", and a driven roller 17*b* that is driven and rotated by the driving roller 17*a* and that includes a plurality of teeth on the outer circumference thereof. In the present exemplary embodiment, the motor 30 is also a drive source of the feeding and driving roller 12*a* as described above.

Figure 7:
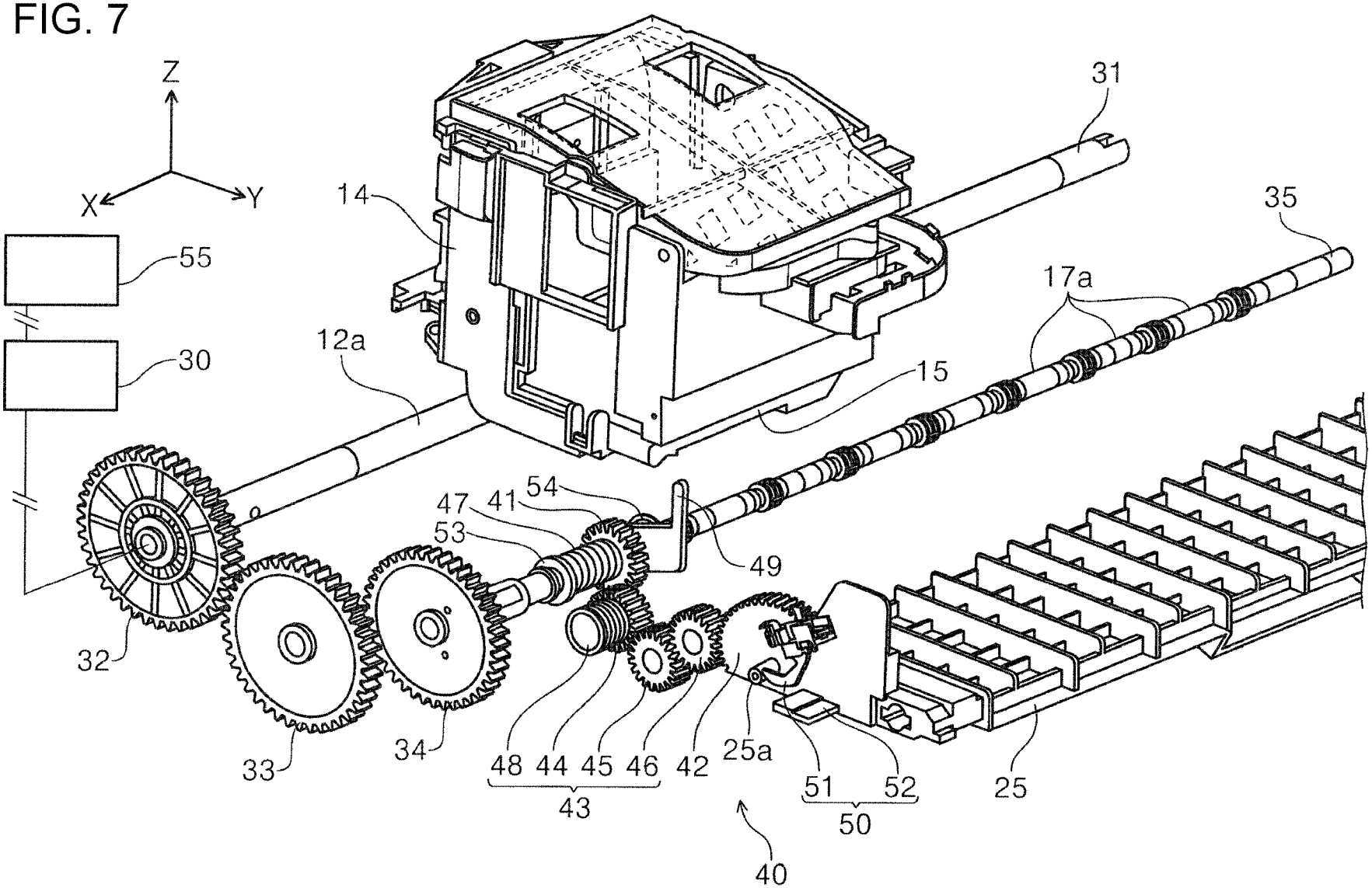
FIG. 7 is a perspective view illustrating a switching mechanism that switches a state of the switching member.

As illustrated in FIG. 7, the motive power of the motor 30 is transmitted to a first transmission gear 32 provided on a rotation shaft 31 of the feeding and driving roller 12*a*. The rotation of the first transmission gear 32 is transmitted to a third transmission gear 34 provided on a rotation shaft 35 of the driving roller 17*a* through a second transmission gear 33.

The pair of transport rollers 17 are provided between the recording head 15 and the pair of first output rollers 18 described later and transport the medium.

The inversion path T2 (the second transport path) connected to the second output unit 28 serving as a transport destination is provided downstream of the pair of transport rollers 17 in the medium transport direction. Note that in the present exemplary embodiment, the inversion path T2 is a medium transport path from a portion downstream of a nip position of the pair of first output rollers 18 to the second output unit 28. As illustrated in FIG. 3, the inversion path T2 includes an outer bend portion 20*a* and an inner bend portion 20*b*, and the medium P is output from the second output unit 28 after an orientation of a first surface of the medium P opposing the recording head 15 is inverted.

The medium P transported by the pair of transport rollers 17 is sent to the inversion path T2 by the pair of first output rollers 18 positioned downstream of the pair of transport rollers 17 in the medium transport direction. As illustrated in FIG. 3, the pair of first output rollers 18 include a first outputting and driving roller 18*a*, and a first outputting and driven roller 18*b* that is driven and rotated by the first outputting and driving roller 18*a* and that has a plurality of teeth on the outer circumference thereof.

A pair of second output rollers 19 are provided downstream of the inversion path T2 in the medium transport direction. The pair of second output rollers 19 outputs the medium P from the second output unit 28. As illustrated in FIG. 3, the pair of second output rollers 19 include a second outputting and driving roller 19*a*, and a second outputting and driven roller 19*b* that is driven and rotated by the second outputting and driving roller 19*a* and that has a plurality of teeth on the outer circumference thereof.

In the present exemplary embodiment, the motor 30 that is commonly used by the feeding and driving roller 12*a* and the driving roller 17*a* is used as the drive source that drives the first outputting and driving roller 18*a* and the second outputting and driving roller 19*a*.

Note that the feeding and driving roller 12*a*, the driving roller 17*a*, the first outputting and driving roller 18*a*, and the second outputting and driving roller 19*a* may use two or more drive sources. For example, the feeding and driving roller 12*a* and the driving roller 17*a* may be driven with the motor 30 and the first outputting and driving roller 18*a* and the second outputting and driving roller 19*a* may be driven by another drive source.

In a case in which a rotation direction, during recording, when the medium P is sent is referred to as a positive rotation direction, the feeding and driving roller 12*a*, the driving roller 17*a*, the first outputting and driving roller 18*a*, and the second outputting and driving roller 19*a* are configured to rotate in a negative rotation direction opposite to the positive rotation direction. The positive rotation direction is clockwise when viewing FIG. 3 from the front, and the negative rotation direction is counterclockwise in the same drawing.

The medium P output from the second output unit 28 with the pair of second output rollers 19 is stacked on the sheet output tray 7. In so doing, the medium P is stacked on the sheet output tray 7 with the first surface, which is the most recent recording surface, facing downwards. In other words, the inversion path T2 is a transport path in which the medium P is output face down.

Note that a switching member 25 is provided downstream of the pair of first output rollers 18 in the medium transport direction. The switching member 25 is configured to switch between a second state illustrated in FIG. 2 in which the switching member 25 constitutes a portion of a path surface of the inversion path T2, and a first state illustrated in FIG. 4 in which the switching member 25 constitutes a portion of a path surface of the straight path T3 serving as a "first transport path" extending towards the first output unit 13.

By switching the switching member 25, the medium P after recording can be output to the first output unit 13, which is a transport destination different from the second output unit 28.

Figure 4:
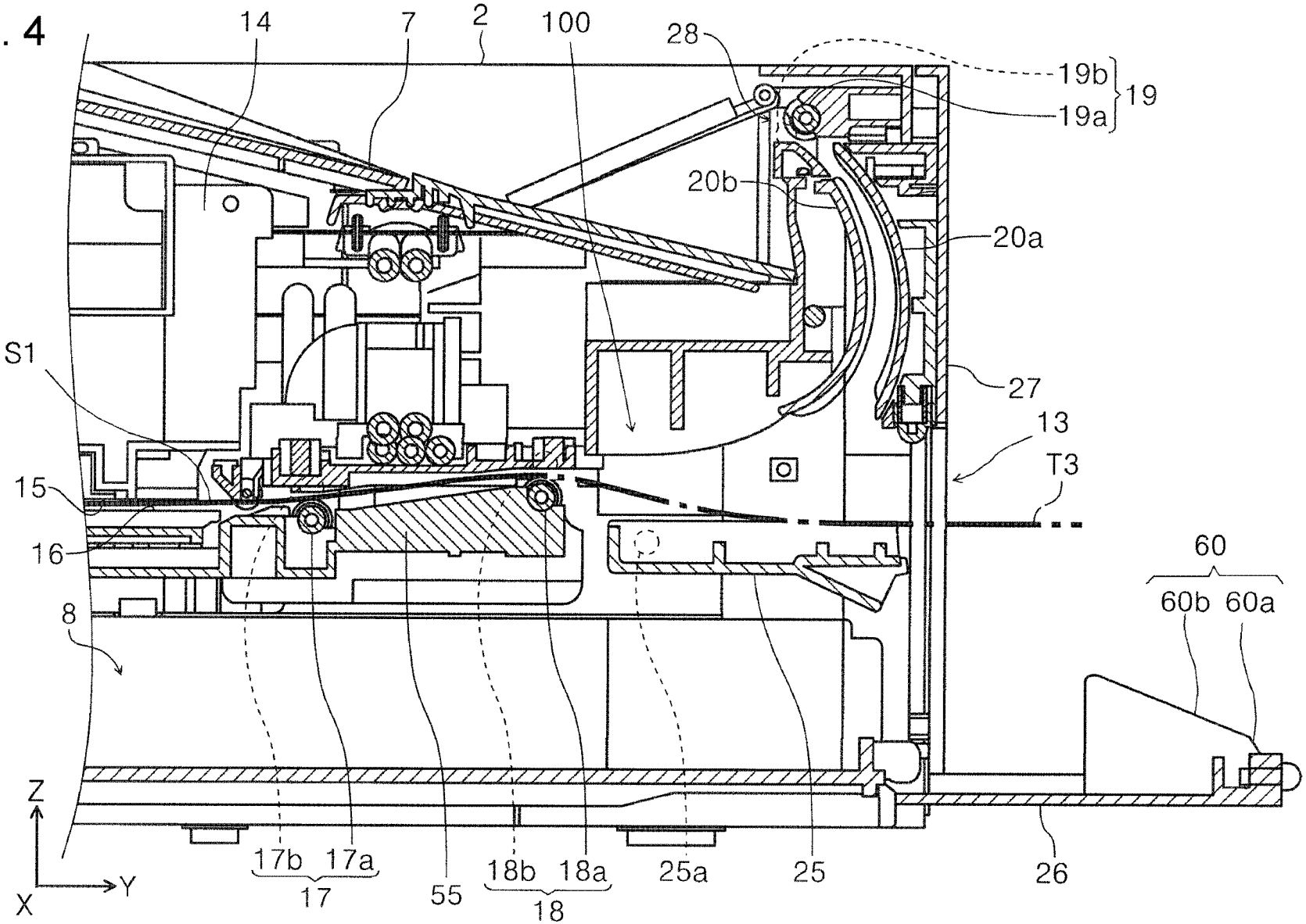
FIG. 4 is a sectional side view of the printer in which the switching member is in the first state and in which a first cover is in an open state to expose a first output unit.
Figure 5:
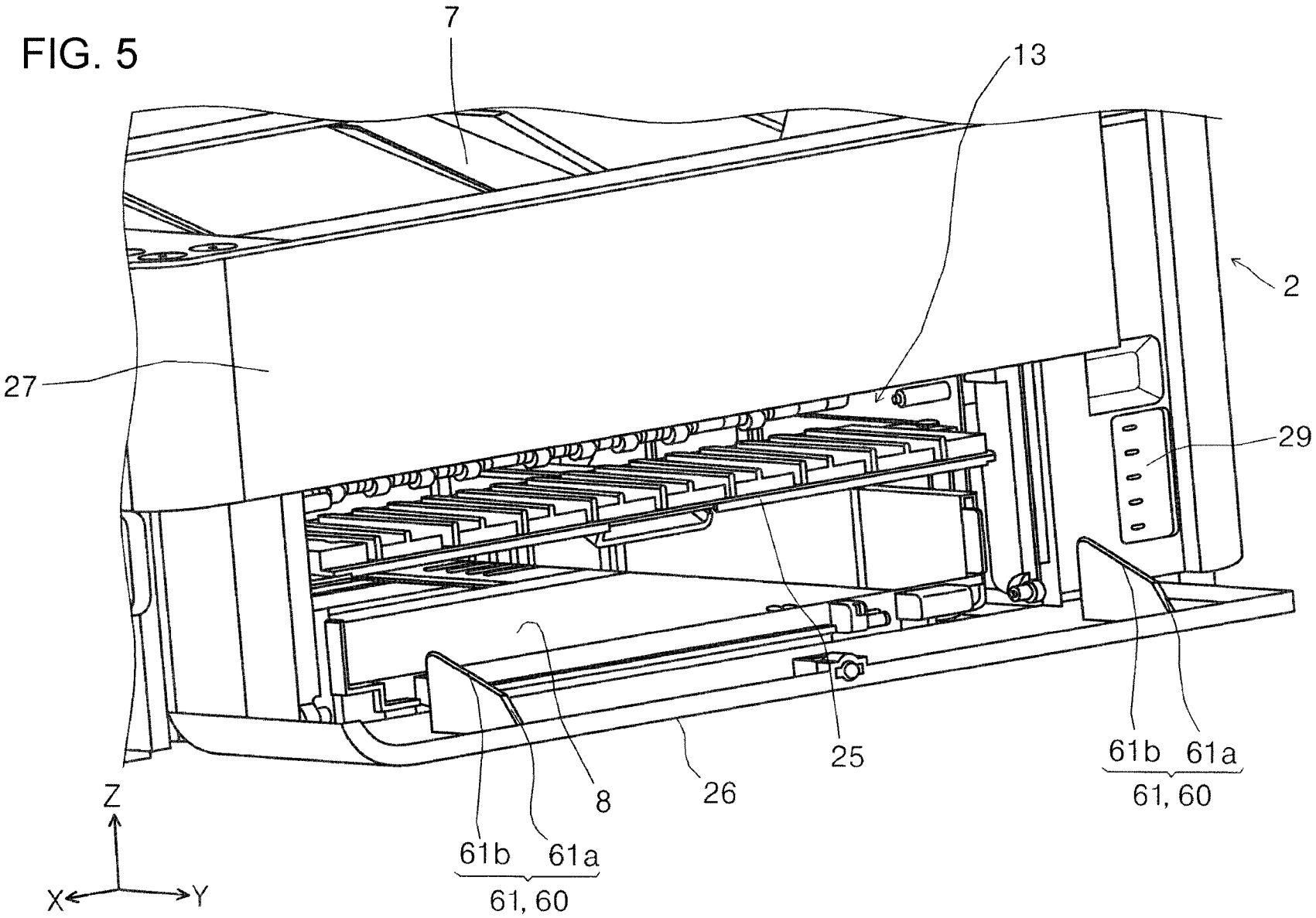
FIG. 5 is a perspective view of the printer in which the switching member is in the first state and in which the first cover is in the open state to expose the first output unit.

A first cover 26 is provided on a lateral surface of the housing 2 on the +Y direction side illustrated in FIG. 1. The first cover 26 is provided in an openable and closable manner with respect to the housing 2. FIGS. 4 and 5 illustrate a state in which the first cover 26 is open. When the first cover 26 is opened, the first output unit 13 becomes usable as an outlet of the medium P. The first cover 26 is configured so that the lower end portion of the housing 2 is a pivoting fulcrum and so that an end portion of the first cover 26 on the +Z direction side is a free end.

In other words, the medium transporting apparatus 100 includes the first cover 26 serving as an "opening/closing body" configured to switch between a closed state illustrated in FIG. 3 in which the first cover 26 covers the first output unit 13, which is an outlet of the medium P transported through the straight path T3, and an open state illustrated in FIG. 4 in which the first output unit 13 is exposed with respect to the closed state.

By having the first cover 26 be in the closed state when the first output unit 13 is not in use, entry of dust into the housing 2 can be prevented.

As illustrated in FIGS. 4 and 5, when the first cover 26 is set to the open state, portions of the switching member 25 and the medium containing unit 8 become exposed. When the first cover 26 is in the open state, a portion of the medium containing unit 8 can be pulled out to the +Y side of the housing 2, and the medium can be readily supplied to the medium containing unit 8.

Figure 6:
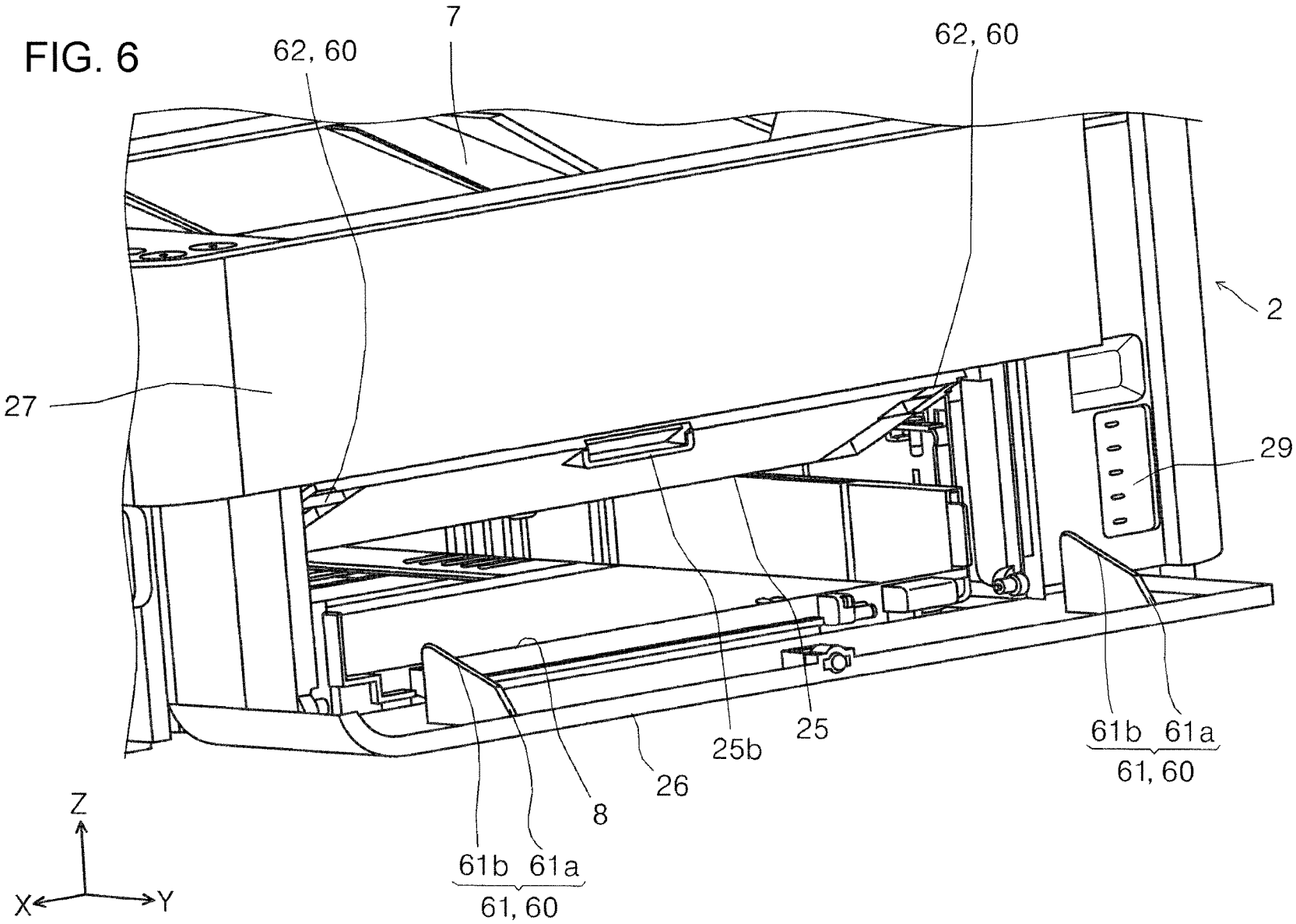
FIG. 6 is a perspective view of the printer in which the switching member is in the second state and in which the first cover is in the open state.

Note that the switching member 25 illustrated in FIG. 5 is in the first state in which the path surface of the straight path T3 is formed, and the switching member 25 illustrated in FIG. 6 is in the second state in which the path surface of the inversion path T2 is formed. The first cover 26 is configured to be manually openable regardless of whether the switching member 25 is in the first state or is in the second state.

Outputting of the medium to the first output unit 13 will be described below.

Regarding Outputting of Medium to First Output Unit

As described above, the medium P on which recording has been performed with the recording head 15 can also be output from the first output unit 13 through the straight path T3 serving as the "first transport path" illustrated in FIG. 4. Specifically, the inversion path T2 and the straight path T3 are branched from the medium transport path T1 at a portion downstream of the recording head 15 in the medium transport direction.

As illustrated in FIG. 3, the inversion path T2 is a path that is curved upwards and, conversely, as illustrated in FIG. 4, the straight path T3 is a path that extends from the medium transport path T1 without being curved. In other words, the straight path T3 that is the "first transport path" is a non-inversion path that outputs the medium P without inverting the bearing of the first surface opposing the recording head 15, and the inversion path T2 that is the "second transport path" is an inversion path that outputs the medium P after inverting the bearing of the first surface.

By switching the state of the switching member 25 from the first state illustrated in FIG. 2 to the second state illustrated in FIG. 4, the medium P can be sent to the straight path T3 and can be output from the first output unit 13.

A configuration that switches the state of the switching member 25 will be described later in detail.

Regarding Medium Transport Path from Back Surface Side Feeding Unit

Referring next to FIG. 2, transportation of the medium from the back surface side feeding unit 21 will be described. The back surface side feeding unit 21 is provided at an end portion of the housing 2 on the −Y direction side. The back surface side feeding unit 21 includes a feed port cover 22. The feed port cover 22 is configured to pivot relative to the housing 2 and is configured to switch between a closed state and an open state (not shown). By setting the medium P on the back surface side feeding unit 21 while having the feed port cover 22 in the open state, the medium P can be fed towards the recording head 15. Note that in FIG. 2, a medium transport path from the back surface side feeding unit 21 is depicted by a dot and dash line indicated by reference numeral T4. Hereinafter, the medium transport path from the back surface side feeding unit 21 is referred to as a back surface side transport path T4.

A feed roller 23 and a separating roller 24 are provided downstream of the feed port cover 22. The medium set on the back surface side feeding unit 21 is nipped and transported by the feed roller 23 and the separating roller 24. At a portion upstream of the pair of feed rollers 12, the back surface side transport path T4 merges with the medium transport path T1 from the medium containing unit 8 described above. After the above, same as the medium transport path T1, the medium is sent to the recording head 15 and recording is performed thereon, and the medium is output from the first output unit 13 or the second output unit 28 through the straight path T3 or the inversion path T2.

The above is a description of the medium transport path in the printer 1. Subsequently, a description of the medium transporting apparatus 100 will be given.

Regarding Medium Transporting Apparatus

The medium transporting apparatus 100 that transports the medium P in the printer 1 includes the straight path T3 that is the "first transport path" to output the medium P to the first output unit 13 illustrated in FIG. 4, the inversion path T2 that is the "second transport path" to output the medium P to the second output unit 28 that is an output destination different from the first output unit 13, the switching member 25 that is provided downstream of the recording head 15 in the medium transport direction and that is configured to switch between the first state illustrated in FIG. 4 in which the switching member 25 constitutes a portion of the path surface of the straight path T3 and the second state illustrated in FIG. 3 in which the switching member 25 constitutes a portion of the path surface of the inversion path T2, the motor 30 that is the "drive source" that drives the pair of transport rollers 17 serving as the "transport unit" that transports the medium P, and a switching mechanism 40 that switches the switching member 25 between the first state and the second state with the motive power of the motor 30. Note that the motor 30 is illustrated in FIG. 3. The switching mechanism 40 is illustrated in FIG. 7.

Note that from a different viewpoint, the medium transporting apparatus 100 can be regarded as an apparatus in which the recording function has been removed from the printer 1. Alternatively, even when the medium transport apparatus 100 has a recording function, when focusing on the viewpoint of medium transportation, the printer 1 itself can be regarded as a medium transporting apparatus.

Hereinafter, the switching member 25 and the switching mechanism 40 that switches the state of the switching member 25 will be described.

Regarding Switching Member and Switching Mechanism

As illustrated in FIGS. 3 and 4, the switching member 25 includes a pivot shaft 25*a* on the −Y side that is upstream in the medium transport direction, and swings the +Y side thereof on the downstream side as a free end to switch between the first state illustrated in FIG. 4 and the second state illustrated in FIG. 3. The switching member 25 is, as an example, configured as a flat plate-shaped member.

The switching mechanism 40 of the present exemplary embodiment illustrated in FIG. 7 is configured to switch between a transmitting state in which the motive power of the motor 30 is transmitted to the switching member 25 and a non-transmitting state in which the motive power of the motor 30 is not transmitted to the switching member 25. The switching between the transmitting state and the non-transmitting state of the switching mechanism 40 is performed by a moving operation of the carriage 14. Note that FIG. 7 illustrates a case in which the switching member 25 is in the first state and the switching mechanism 40 is in the non-transmitting state.

Hereinafter, the switching mechanism 40 will be described in more detail.

As illustrated in FIG. 7, the switching mechanism 40 includes a first gear 41 provided coaxial with the rotation shaft 35 of the driving roller 17*a*, a second gear 42 provided coaxially with the pivot shaft 25*a* of the switching member 25, and intermediate gear train 43 that transfers motive power from the first gear 41 to the second gear 42. The first gear 41 is configured to move in the X-axis direction, which is the width direction, between a first position A1 (FIGS. 10, 11, 14, and 15) in which the first gear 41 meshes with the intermediate gear train 43 and sets the switching mechanism 40 to a transmitting state, and a second position A2 (FIGS. 8, 9, 12, and 13) in which the first gear 41 is separated from the intermediate gear train 43 and sets the switching mechanism 40 to a non-transmitting state.

In the present exemplary embodiment, the intermediate gear train 43 includes three gears, namely, a first intermediate gear 44, a second intermediate gear 45, and a third intermediate gear 46; however, the intermediate gear train 43 may include one or more optional number of gears.

The switching mechanism 40 includes a first coil spring 47 serving as a "pressing unit". The first gear 41 is pressed by a first coil spring 47 from a first position A1 illustrated in FIG. 14 towards a second position A2 illustrated in FIG. 13.

Furthermore, the switching mechanism 40 includes an abutment portion 49 that is provided coaxially with the rotation shaft 35 of the first gear 41, and that is configured to be displaced between an advanced position B1 (FIGS. 9 and 14) advanced into a movement area of the carriage 14 and a retracted position B2 (FIGS. 8 and 13) retracted from the movement area of the carriage 14.

The abutment portion 49 is disposed on the −X side that is closer to the home position of the carriage 14 than the first gear 41. The rotation shaft 35 includes a first restricting portion 53 and a second restricting portion 54 spaced apart from the first restricting portion 53. The second restricting portion 54 restricts the abutment portion 49 from moving a predetermined amount or more in the −X direction. The first coil spring 47 is provided between the first restricting portion 53 and the first gear 41 and presses the first gear 41 and the abutment portion 49 toward the −X side.

Figure 8:
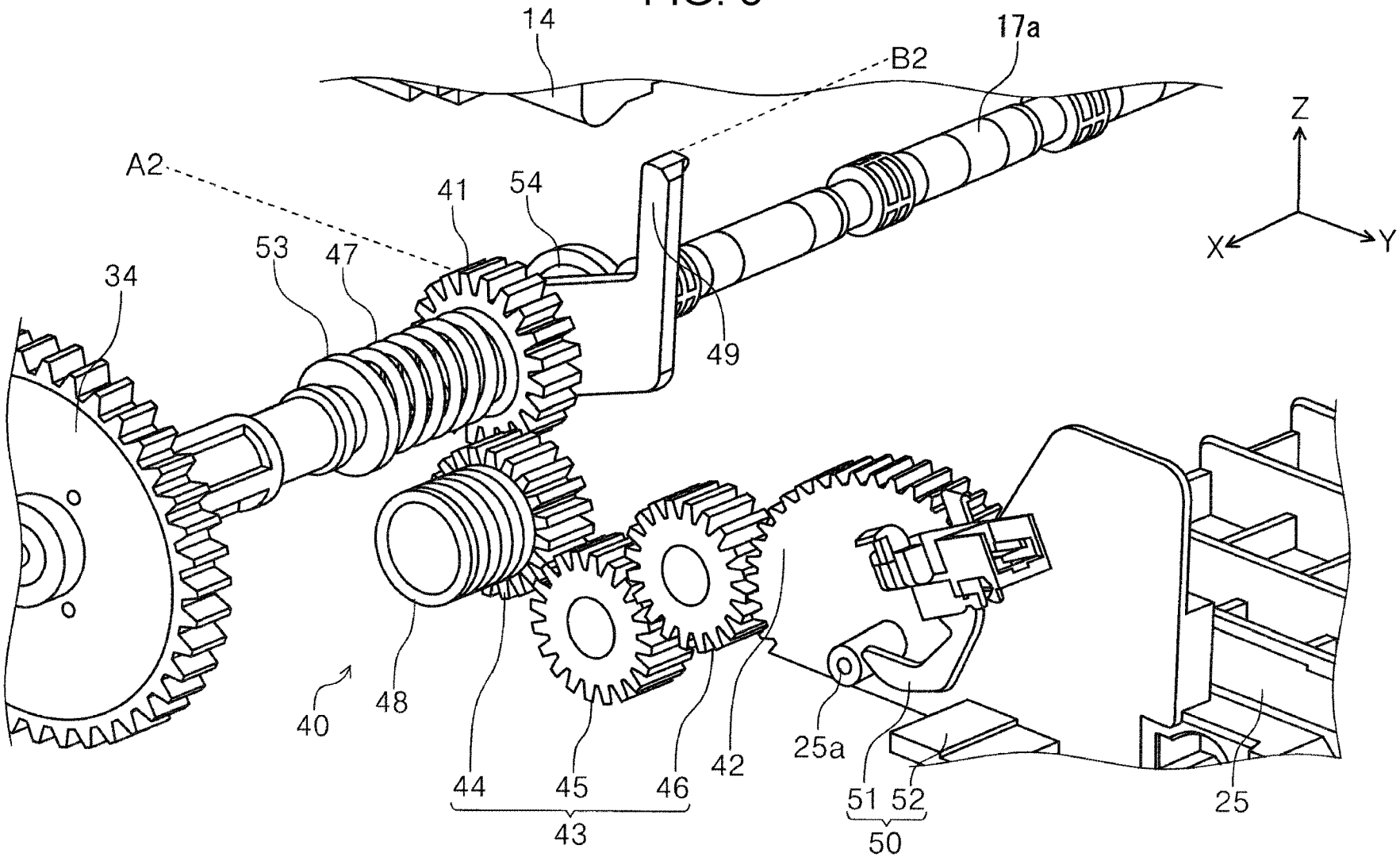
FIG. 8 is a perspective view illustrating a state in which the switching member is in the first state, an abutment portion is at a retracted position, and the switching mechanism is in a non-transmitting state.
Figure 9:
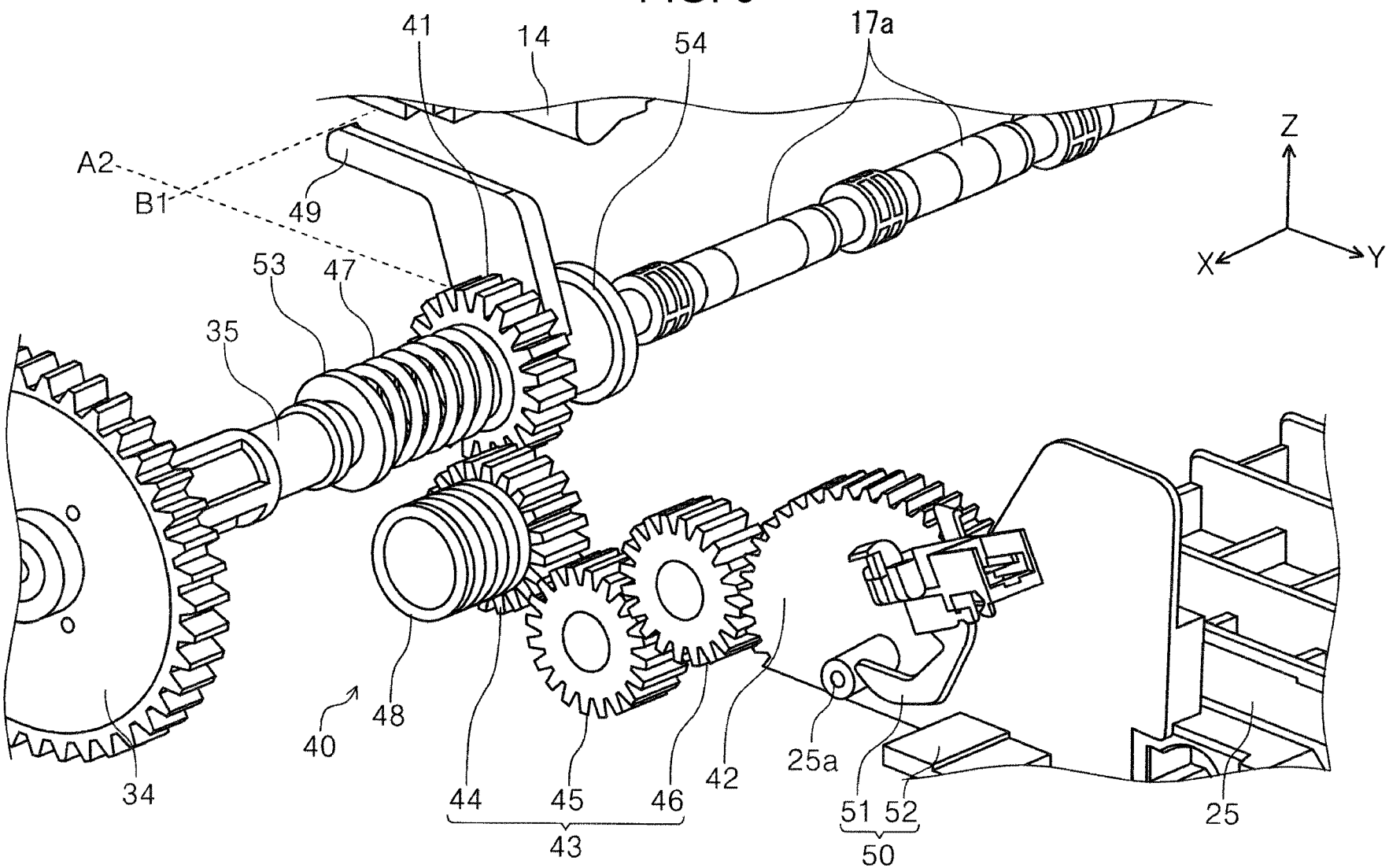
FIG. 9 is a perspective view illustrating a state in which the switching member is in the first state, an abutment portion is at an advanced position, and the switching mechanism is in a non-transmitting state.

The abutment portion 49 is not fixed to the rotation shaft 35; however, when pressed towards the −X side with the first coil spring 47 as shown in FIGS. 8 and 9, the abutment portion 49 is rotatable together with the rotation shaft 35 in an integral manner. In the above state in which the abutment portion 49 is pressed towards the −X side and the driving roller 17*a* rotates in the positive rotation direction, which is the rotation direction when recording is performed on the medium P, the abutment portion 49 is positioned at the retracted position B2 illustrated in FIG. 8. Furthermore, when the driving roller 17*a* rotates in a negative rotation direction opposite to the positive rotation direction, the abutment portion 49 is advanced to the advanced position B1 illustrated in FIGS. 9 to 11.

Accordingly, when performing recording on the medium P accompanying movement of the carriage 14 in the width direction, the abutment portion 49 can be prevented from interfering with the movement of the carriage 14.

Note that as an example of another situation in which the driving roller 17*a* is rotated in the negative rotation direction, there is a case in which the medium P is drawn into the inverting roller 10 after recording on the first surface has been performed when double-sided recording is performed on the medium P. In such a case, since the carriage 14 is not moved when the medium P is drawn in, the abutment portion 49 situated in the advanced position B1 and the carriage 14 will not interfere with each other.

Figure 11:
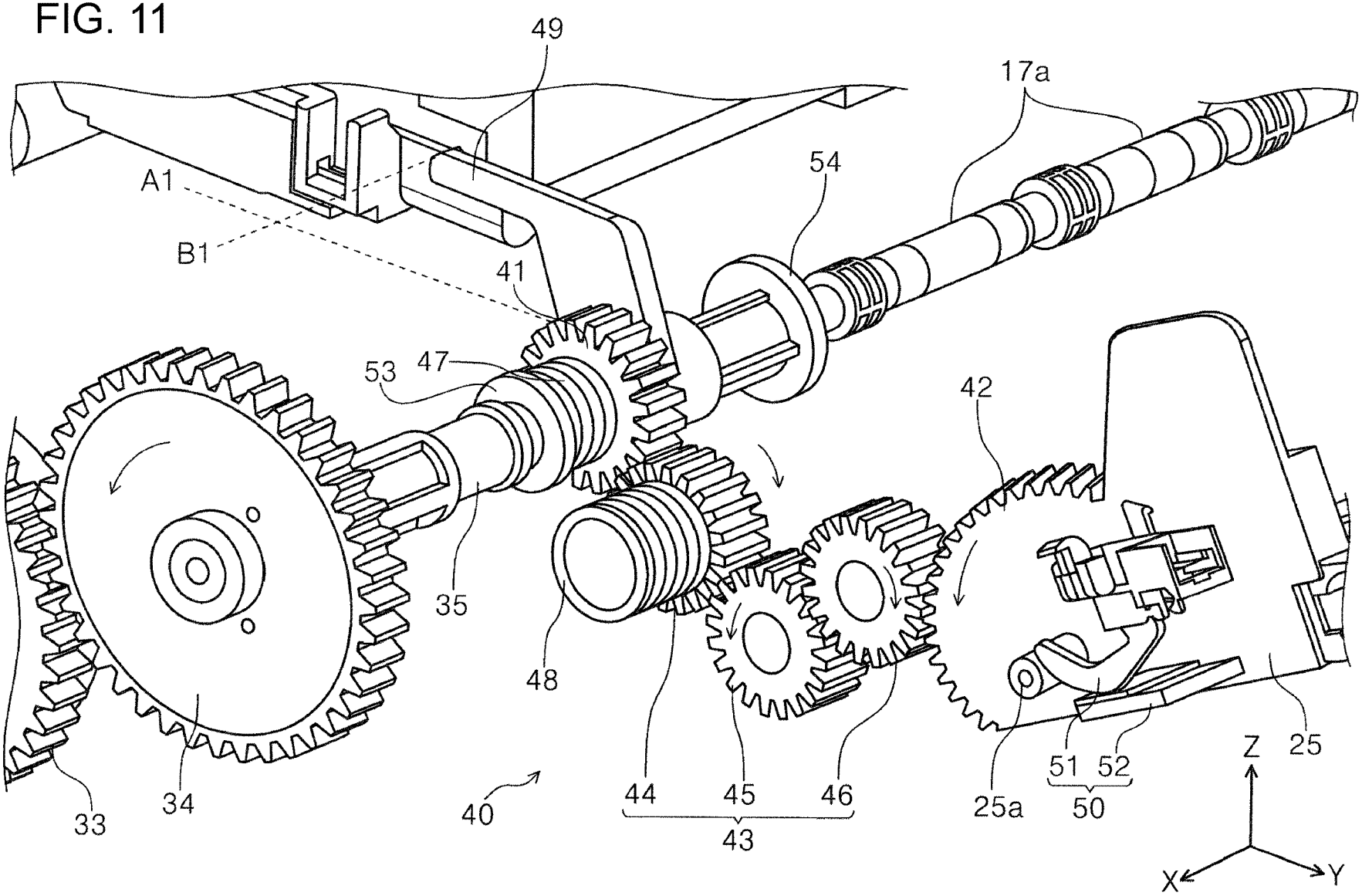
FIG. 11 is a perspective view illustrating a state in which while the switching mechanism is in the transmitting state, the driving roller is rotated in a negative rotation direction, and the switching member is transitioned from the first state to the second state.
Figure 12:
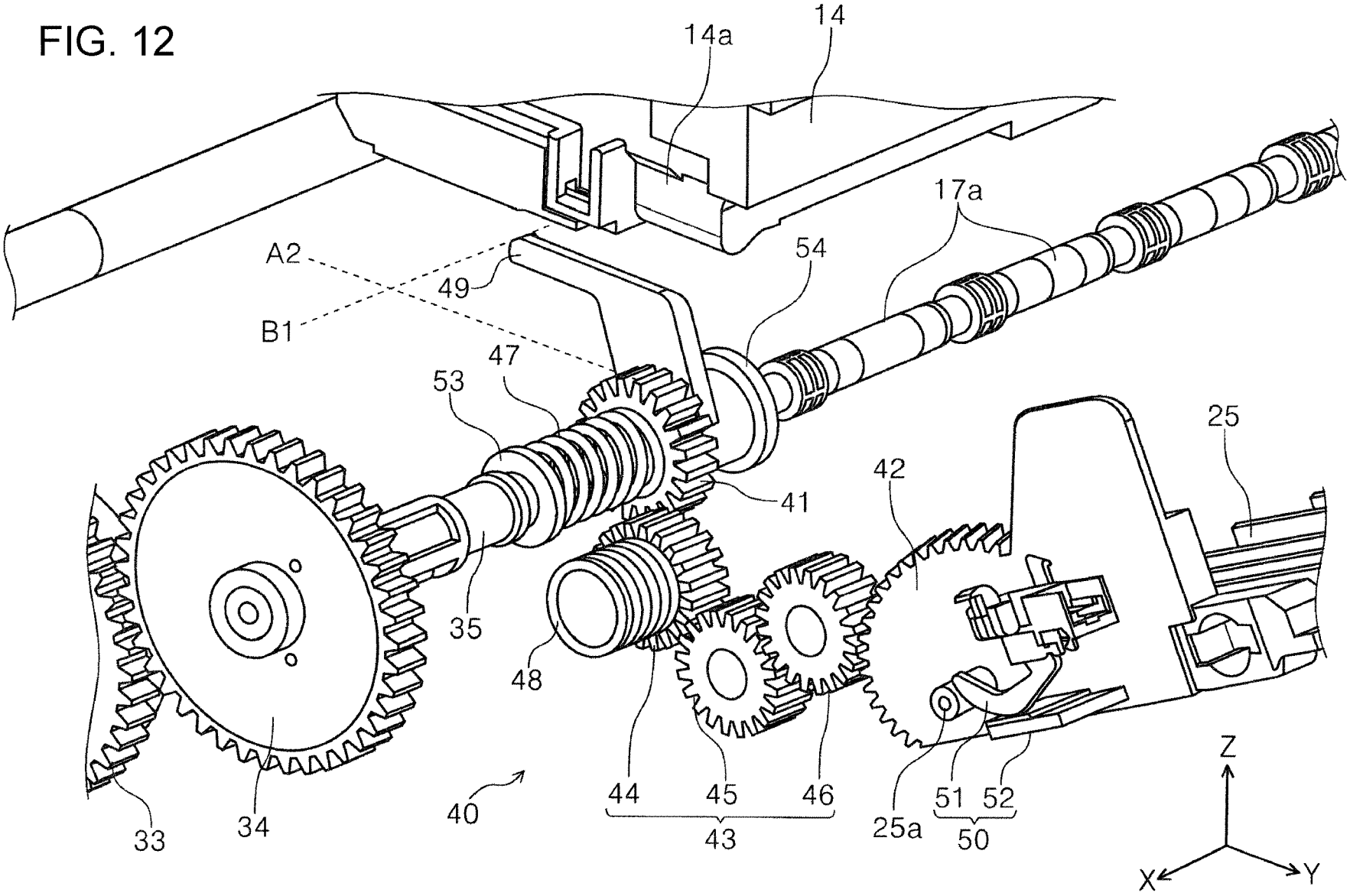
FIG. 12 is a perspective view illustrating a state in which, from the state in FIG. 11, the carriage has been moved towards the home position side and the switching mechanism has been returned to the non-transmitting state.
Figure 13:
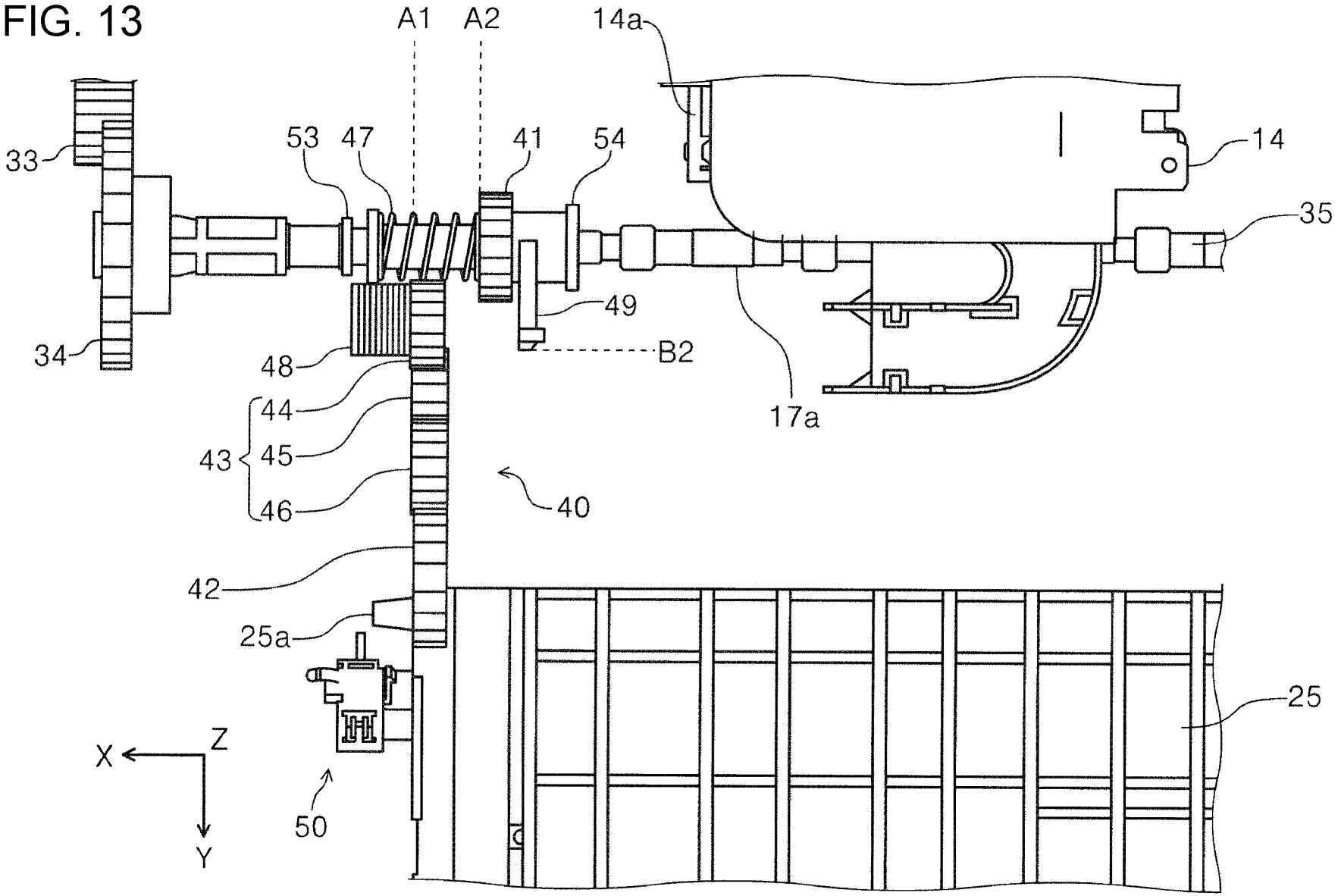
FIG. 13 is a plan view of FIG. 8.
Figure 14:
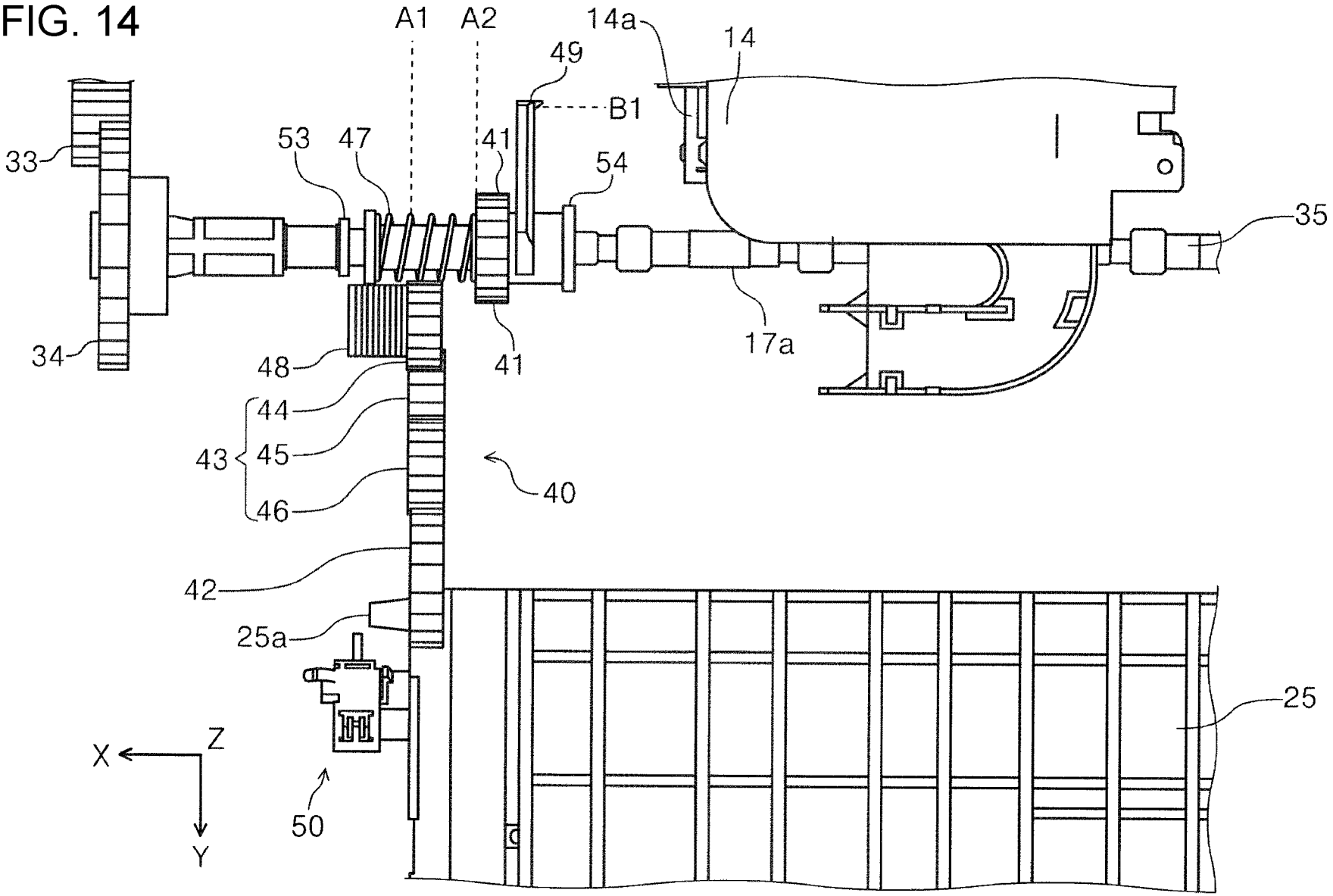
FIG. 14 is a plan view of FIG. 9.
Figure 15:
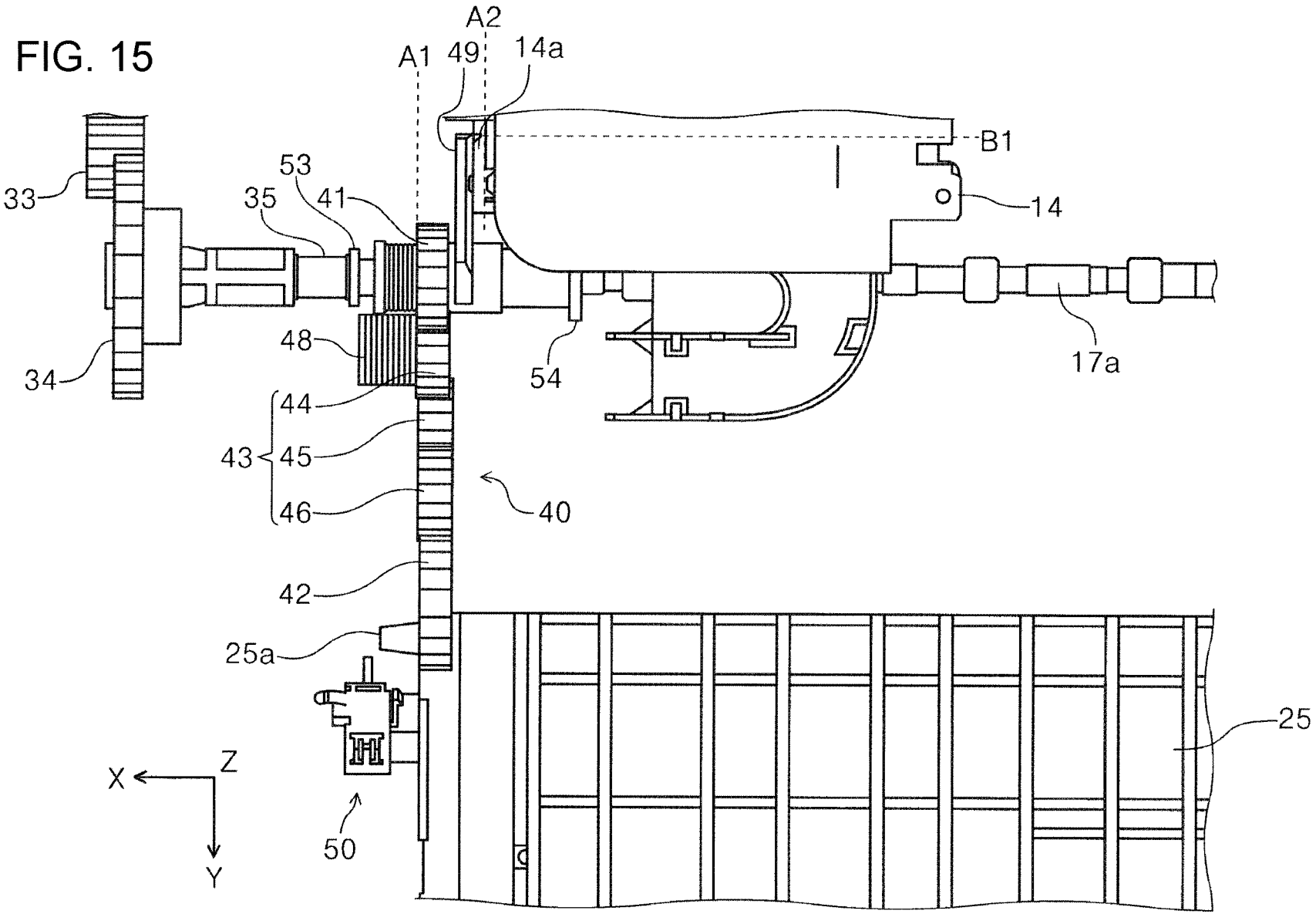
FIG. 15 is a plan view of FIG. 10.

FIGS. 8 to 12 illustrate, in a stepwise manner, the switching member 25 being switched from the first state to the second state. FIGS. 13 to 15 are plan views corresponding to FIGS. 8 to 10, respectively.

In FIGS. 8 and 13, the switching member 25 is in the first state, and as illustrated in FIG. 13, the first gear 41 and the first intermediate gear 44 of the switching mechanism 40 are shifted with respect to each other in the width direction and are not engaged with each other, in other words, FIG. 13 illustrates the non-transmitting state of the switching mechanism 40.

When switching the state of the switching member 25, the driving roller 17*a* is first rotated in the negative rotation direction to bring the abutment portion 49 from the retracted state illustrated in FIGS. 8 and 13 to the advanced state illustrated in FIGS. 9 and 14.

As illustrated in FIGS. 9 and 14, when the abutment portion 49 is set in the advanced state, the carriage 14 is moved from the −X side, or the home position side, towards the +X side. When the carriage 14 is moved towards the +X side, a lateral surface 14*a* of the carriage 14 contacts the abutment portion 49 in the advanced state.

Figure 10:
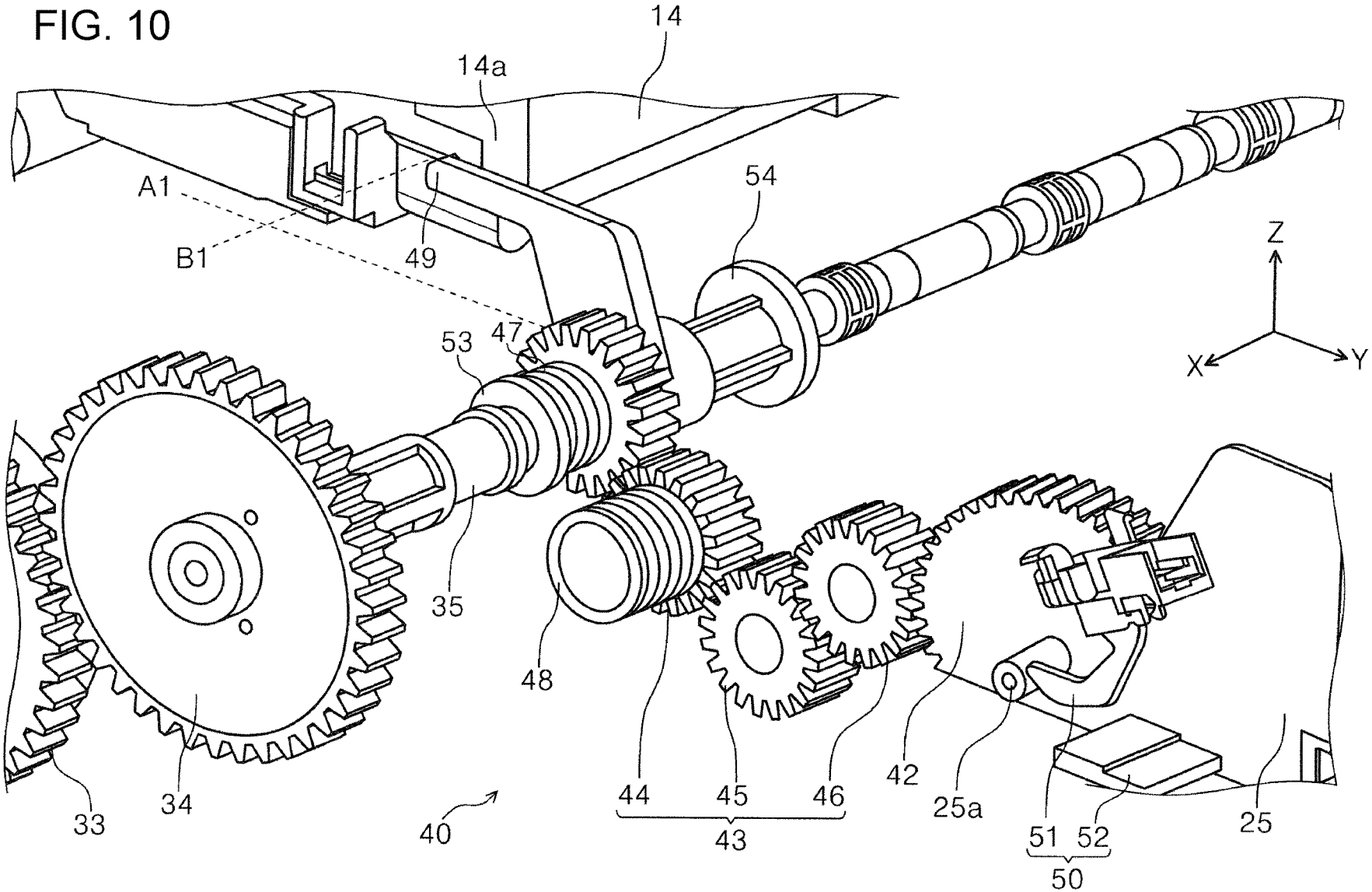
FIG. 10 is a perspective view illustrating a state in which the switching member is in the first state, the abutment portion at the advanced position is moving while being in contact with a carriage, and the switching mechanism is in the transmitting state.

In a state in which the lateral surface 14*a* is in contact with the abutment portion 49 at the advanced position B1, when the carriage 14 is further moved towards the +X side, as illustrated in FIGS. 10 and 15, the first gear 41 countering the pressing force of the first coil spring 47 moves from the second position A2 to the first position A1, and the first gear 41 meshes with the first intermediate gear 44. With the above, the switching mechanism 40 is brought to the transmitting state.

Furthermore, as illustrated in FIG. 11, when the driving roller 17*a* is rotated in the negative rotation direction, that is, when the rotation shaft 35 is rotated counterclockwise when FIG. 11 is viewed from the front, the motive power is transmitted from the first gear 41 to the second gear 42 through the first intermediate gear 44, the second intermediate gear 45, and the third intermediate gear 46, and the second gear 42 is rotated counterclockwise. Accordingly, the switching member 25 is swung from the first state to the second state.

Note that as illustrated in FIGS. 10 and 15, when the abutment portion 49 is pushed towards the +X side with the carriage 14 and the pressing force of the first coil spring 47 is not applied to the abutment portion 49, the abutment portion 49 does not follow the rotations of the driving roller 17*a* and the rotation shaft 35 even when the driving roller 17*a* and the rotation shaft 35 rotate.

When the switching member 25 switches from the first state illustrated in FIGS. 8 to 10 to the second state illustrated in FIG. 11, the carriage 14 is moved towards the −X side, which is the direction in which the carriage 14 approaches the home position side. Then, as illustrated in FIG. 12, the first gear 41 returns to the second position A2 from the first position A1 and returns to the original state where the first coil spring 47 presses the first gear 41 and the abutment portion 49 against the second restricting portion 54. Accordingly, the first gear 41 and the first intermediate gear 44 are disconnected from each other, and the switching mechanism 40 is brought to the non-transmitting state. The first intermediate gear 44 is pressed between the housing 2 with the second coil spring 48, and after the switching mechanism 40 is brought to the non-transmitting state, the first intermediate gear 44 maintains the switching member 25 in the position of the second state with the load of the second coil spring 48.

In order to change the switching member 25 to the first state from the second state, the driving roller 17*a* is rotated in the positive rotation direction after setting the switching mechanism 40 to the transmitting state.

In a state in which the carriage 14 is in contact with the abutment portion 49 at the advanced position B1, when the switching mechanism 40 moves towards the +X side, which is a direction moving away from the home position located on the −X side, the first gear 41 moves from the second position A2 to the first position A1. In a state in which the carriage 14 is in contact with the abutment portion 49 at the advanced position B1, when the switching mechanism 40 moves towards the −X side, which is a direction approaching the home position, the first gear 41 moves from the first position A1 to the second position A2. With the above relatively simple mechanical configuration, the transmitting state and the non-transmitting state of the switching mechanism 40 can be switched.

As described above, by having the medium transporting apparatus 100 include the switching mechanism 40 that switches the switching member 25 between the first state and the second state with the motive power of the motor 30, the switching of the transport path of the medium P on which recording has been performed between the inversion path T2 and the straight path T3 can be performed using the motive power of the motor 30 that is the drive source of the pair of transport rollers 17. Accordingly, there is no need to provide a dedicated drive source that drives the switching member 25, and the medium transporting apparatus 100 can be manufactured at a low cost.

The intermediate gear train 43 constituting the switching mechanism 40 may be configured to include a friction clutch mechanism that idles when a torque exceeding a predetermined value is applied. In the present exemplary embodiment, the second intermediate gear 45 is provided with a friction clutch mechanism.

As illustrated in FIG. 6, the switching member 25 is provided with a hand holding portion 25*b* at a position that becomes visible when the first cover 26 is opened so that the users can manually perform opening and closing. Since the friction clutch mechanism is provided, for example, when a user moves the switching member 25 manually and a predetermined torque or a larger torque is applied thereto, the second intermediate gear 45 provided with the friction clutch mechanism idles; accordingly, the occurrence of damage in the gears constituting the switching mechanism 40 can be reduced.

Furthermore, as illustrated in FIG. 7, a detection unit 50 that detects the state of the switching member 25 is provided in the medium transporting apparatus 100 illustrated in FIG. 2. In the present exemplary embodiment, a lever sensor is used as the detection unit 50, for example. The detection unit 50 includes a detection lever 51 fixed inside the housing 2 and a contact portion 52 provided on the switching member 25.

The detection unit 50 according to the present exemplary embodiment is set so that when the switching member 25 reaches the second state illustrated in FIG. 3, the contact portion 52 presses the detection lever 51 and the switching member 25 is brought to a detected state, as illustrated in FIG. 11, and when the switching member 25 reaches the first state illustrated in FIG. 4, the contact portion 52 is separated from the detection lever 51 and the switching member 25 is brought to a non-detected state, as illustrated in FIG. 8. It goes without saying that the detection unit 50 may be configured so that the detected state of the switching member 25 is the first state and the non-detected state is the second state.

By providing the detection unit 50, the switched state of the switching member 25 can be detected and understood. Other than a mechanical sensor such as the lever sensor of the present exemplary embodiment, the detection unit 50 can also use an optical sensor such as a magnetic sensor or a photo-interrupter, for example.

Furthermore, the medium transporting apparatus 100 illustrated in FIG. 2 may be configured to include an interlocking mechanism 60 configured to switch the first cover 26 from the closed state to the open state in conjunction with the switching of the switching member 25 from the second state to the first state. By providing the interlocking mechanism 60, the first output unit 13 can be reliably exposed and the medium P can be reliably output to the outside of the housing 2 when the medium P is output through the straight path T3. Hereinafter, a specific configuration of the interlocking mechanism 60 will be described.

As illustrated in FIG. 6, the interlocking mechanism 60 includes tray engaging portions 61 provided at an end portion of the first cover 26 on the −Y side when the first cover 26 is in an open state and engaged portions 62 provided on the free end side of the switching member 25. The tray engaging portions 61 each include an engagement portion 61*a* and an inclined surface 61*b*.

Figure 16:
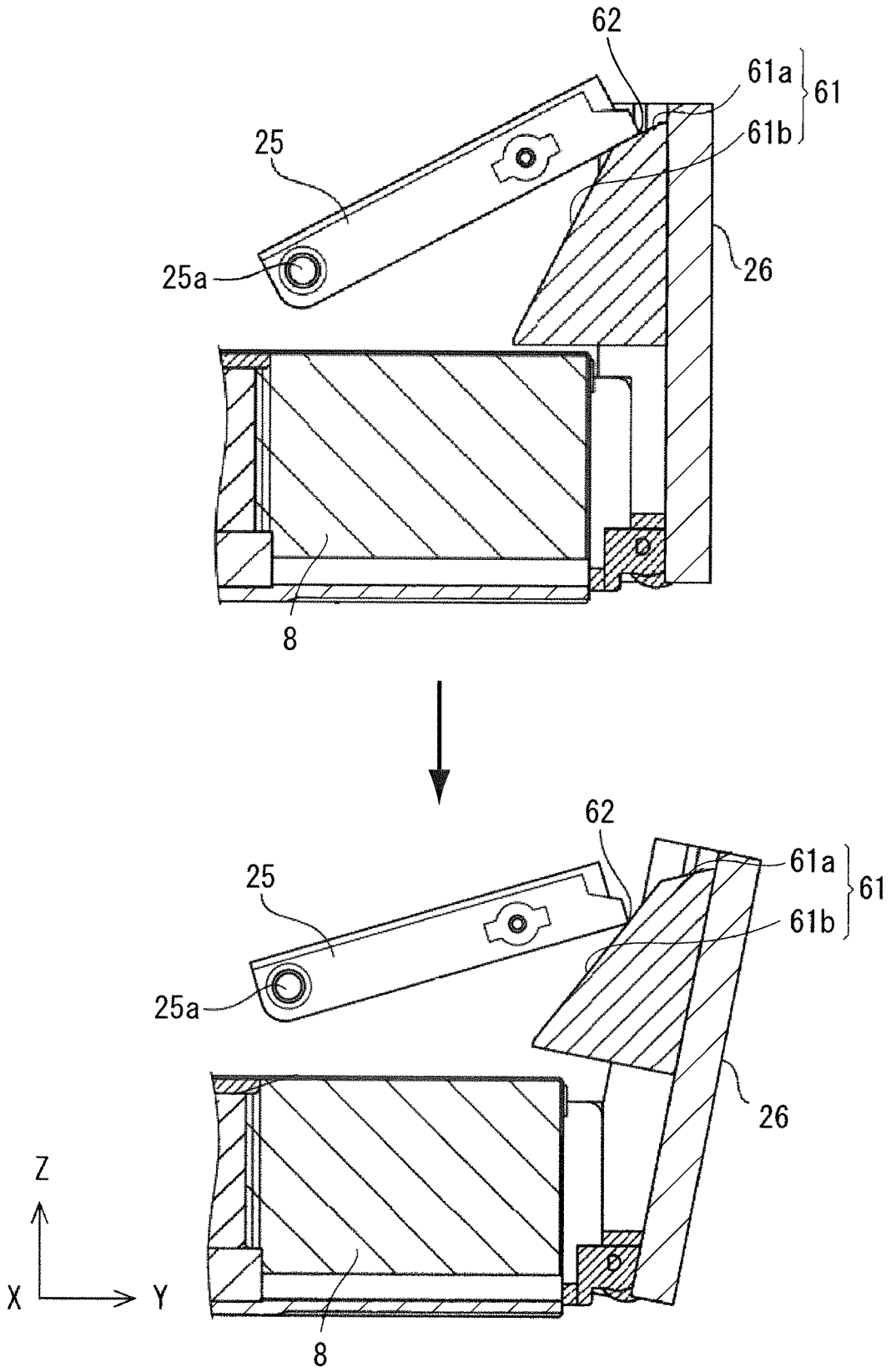
FIG. 16 is a diagram illustrating an interlocking mechanism.

As illustrated in the upper diagram in FIG. 16, when the first cover 26 is in the closed state, the switching member 25 is in the second state and the engaged portions 62 are in contact with the engagement portions 61*a*.

As illustrated in the lower diagram in FIG. 16, when the switching member 25 is swung from the second state to the first state, the engaged portions 62 of the switching member 25 are pushed down and the engagement with the engagement portions 61*a* is released and the first cover 26 opens towards the open state from the closed state by its own weight.

With the interlocking mechanism 60 having the above configuration, the first cover 26 can be switched from the closed state to the open state in conjunction with the switching of the switching member 25 from the second state to the first state.

Note that when the first cover 26 is switched from the open state to the closed state, the first cover 26 is closed manually. Since the tray engaging portions 61 are provided with the inclined surfaces 61*b*, the engaged portions 62 of the switching member 25 are guided to the inclined surfaces 61*b* and the switching member 25 is pushed up; accordingly, the engaged portions 62 and the engagement portions 61*a* can be engaged to each other smoothly.

State Switching of Switching Member

The control unit 55 that controls the state switching operation of the switching member 25 is provided. The control unit 55 is configured to switch the state of the switching member 25 by controlling the drive of the motor 30 according to various conditions. Hereinafter, an example of control of the switching member 25 performed by the control unit 55 will be described.

First Control

The control unit 55 can switch the state of the switching member 25 according to the type or size of the transported medium P. Hereinafter, the above control is referred to as a first control.

For example, in a curved inversion path T2 illustrated in FIG. 3, a medium with high rigidity, such as thick paper or coated paper for photographs, has difficulty in following along the curve and is easily jammed. Furthermore, as the rigidity of the medium P becomes lower, the front end of the medium P becomes easily buckled, and the medium easily becomes jammed in the curved path.

Accordingly, the occurrence of jamming of the medium during outputting the medium P can be reduced by controlling the switching member 25 to transport and output the medium with a rigidity that is higher or lower than a predetermined rigidity through the straight path T3 illustrated in FIG. 4.

Furthermore, in the inversion path T2, the medium P is transported by the pair of first output rollers 18 and the pair of second output rollers 19 illustrated in FIG. 3. When the length of the medium P in the medium transport direction is shorter than the interval between the pair of first output rollers 18 and the pair of second output rollers 19, there are cases in which the medium P is jammed midway of the inversion path T2. Accordingly, the medium P whose length in the medium transport direction is shorter than the distance between the pair of first output rollers 18 and the pair of second output rollers 19 is desirably transported and output through straight path T3.

The control unit 55 stores, in a storage unit (not shown), the desirable types or sizes of the medium P, which is to be transported and output through the straight path T3, as a first group. For example, in the first group, thick paper having a thickness or basis weight equivalent to or larger than a predetermined value, thin paper having a thickness or basis weight equivalent to or smaller than a predetermined value, coated paper such as photographic paper, postcard that is short in the medium transport direction, name card, and the like are classified. Furthermore, as an example, the classification of the first group may include a case in which a B5-sized medium in which the long side thereof is longer than the interval between the pair of first output rollers 18 and the pair of second output rollers 19 but the short side thereof is shorter than the interval between the pair of first output rollers 18 and the pair of second output rollers 19 is transported sideways.

Figure 17:
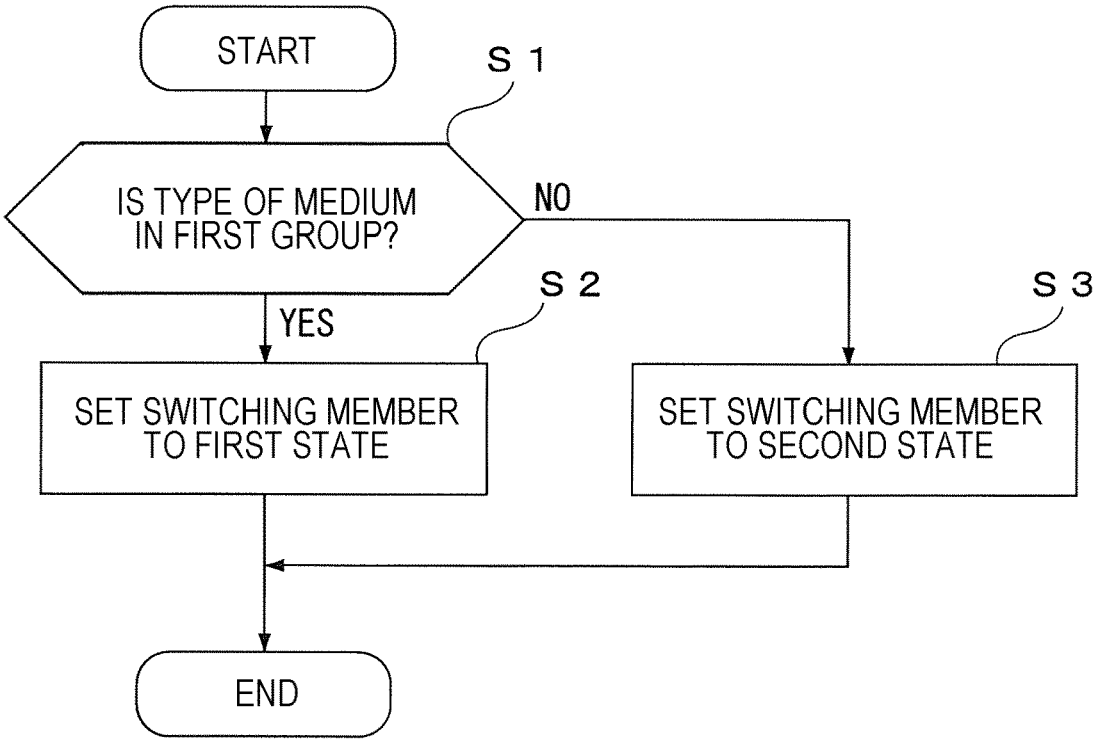
FIG. 17 is a flowchart illustrating a first control with a control unit.

As illustrated in FIG. 17, in step S1, the control unit 55 determines whether the transported medium P is a medium in the first group. If the medium P is a medium in the first group, in other words, if the output is YES in step S1, the process proceeds to step S2 and the switching member 25 is set to the first state. With the above, the medium P that is easily jammed in the inversion path T2 is transported to the straight path T3 and is output from the first output unit 13.

On the other hand, if the medium P is not a medium in the first group, in other words, if the output is NO in step S1, the process proceeds to step S3 and the switching member 25 is set to the second state. With the above, the medium P is transported to the inversion path T2 and is output from the second output unit 28.

The control unit 55 uses, as information of the transported medium P, information of the medium P input in the operation unit 6 or information of the medium P input through an external input device such as a computer or the like connected to the printer 1, for example. Furthermore, a size detection unit configured to detect the size of the medium P can be provided in the medium transport path T1, and step S1 can be performed based on a detection result of the size detection unit. As described above, by having the control unit 55 switch the state of the switching member 25 according to the type or size of the transported medium P, the transport path suitable for the transported medium P can be selected. Accordingly, occurrence of jamming in the transport path can be reduced.

Second Control

Furthermore, the control unit 55 can switch the state of the switching member 25 according to the liquid ejection volume of the recording head 15 on the medium P per unit area. Hereinafter, the above control is referred to as a second control.

When the liquid ejection volume per unit area on the medium P ejected by the recording head 15 is large, that is, when high duty recording is performed, the medium P after the recording may be wet and the rigidity thereof may have decreased. The front end of the medium with low rigidity is buckled easily, and jamming may easily occur in the curved inversion path T2.

Figure 18:
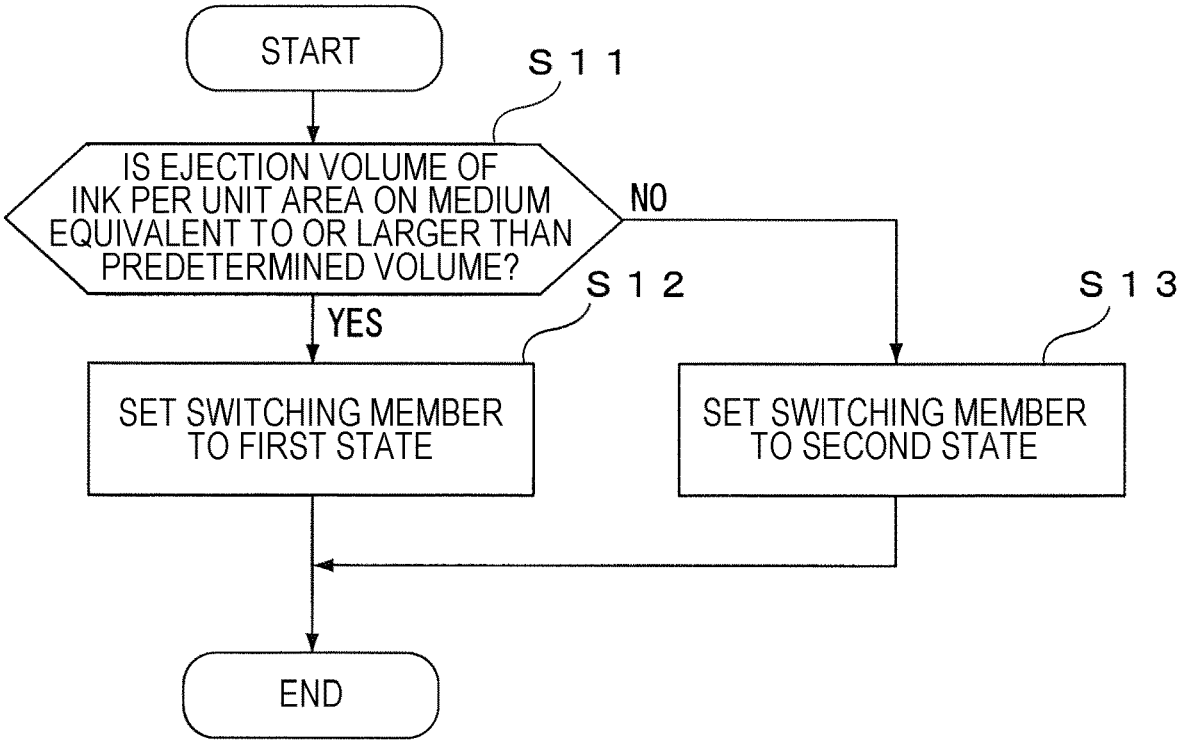
FIG. 18 is a flowchart illustrating a second control with a control unit.

As illustrated in FIG. 18, in step S11, the control unit 55 determines whether the liquid ejection volume per unit area on the medium P ejected by the recording head 15 is equivalent to or larger than a predetermined amount. If the liquid ejection volume per unit area on the medium P is equivalent to or larger than the predetermined amount, in other words, if the output is YES in step S11, the process proceeds to step S12 and the switching member 25 is set to the first state. With the above, the medium P is transported to the straight path T3 and is output from the first output unit 13.

On the other hand, if the liquid ejection volume per unit area on the medium P is smaller than the predetermined amount, in other words, if the output is NO in step S11, the process proceeds to step S13 and the switching member 25 is set to the second state. With the above, the medium P is conveyed to the inversion path T2 and is output from the second output unit 28.

As described above, the control unit 55 switches the state of the switching member 25 according to the liquid ejection volume per unit area on the medium P ejected by the recording head 15 and selects the transport path through which the output medium P passes; accordingly, the occurrence of jamming of the medium P, whose rigidity has become low due to recording with high duty, in the inversion path T2 can be reduced.

Other than the above, when the path lengths of the "first transport path" and the "second transport path" having different transport destinations are different from each other, for example, the medium P on which high duty recording has been performed is desirably transported to the transport path having a longer path length. If the transport path to the output unit is long, the time it takes to output will become longer.

When performing continuous recording on a plurality of sheets of medium P, if the recording surface of the previously transported medium P is not dry, ink may adhere when the medium P output from the output unit is stacked; however, by transporting the medium P having a liquid ejection volume per unit area larger than a predetermined amount to a transport path having a longer path length, the long transportation time is used as an ink drying time so that the ink adhesion described above can be suppressed.

The switching state of the switching member 25 can be preset in the operation unit 6, for example. For example, the output destination of the medium P after recording can be selected in the operation unit 6. In such a case, the control unit 55 can switch the state of the switching member 25 based on the setting information in the operation unit 6.

Note that when the output destination is set to the second output unit 28 in the operation unit 6, that is, when the state of the switching member 25 is set to the second state, when the state of the switching member 25 is determined that it should be set to the first state with the first control or the second control of the control unit 55, an alert confirming the user whether the setting set in the operation unit 6 is alright can be issued.

Third Control

The control unit 55 can be configured to set the switching member 25 to the first state illustrated in FIG. 4 when jamming of the medium P has occurred in the inversion path T2. Hereinafter, the above control is referred to as a third control.

Figure 19:
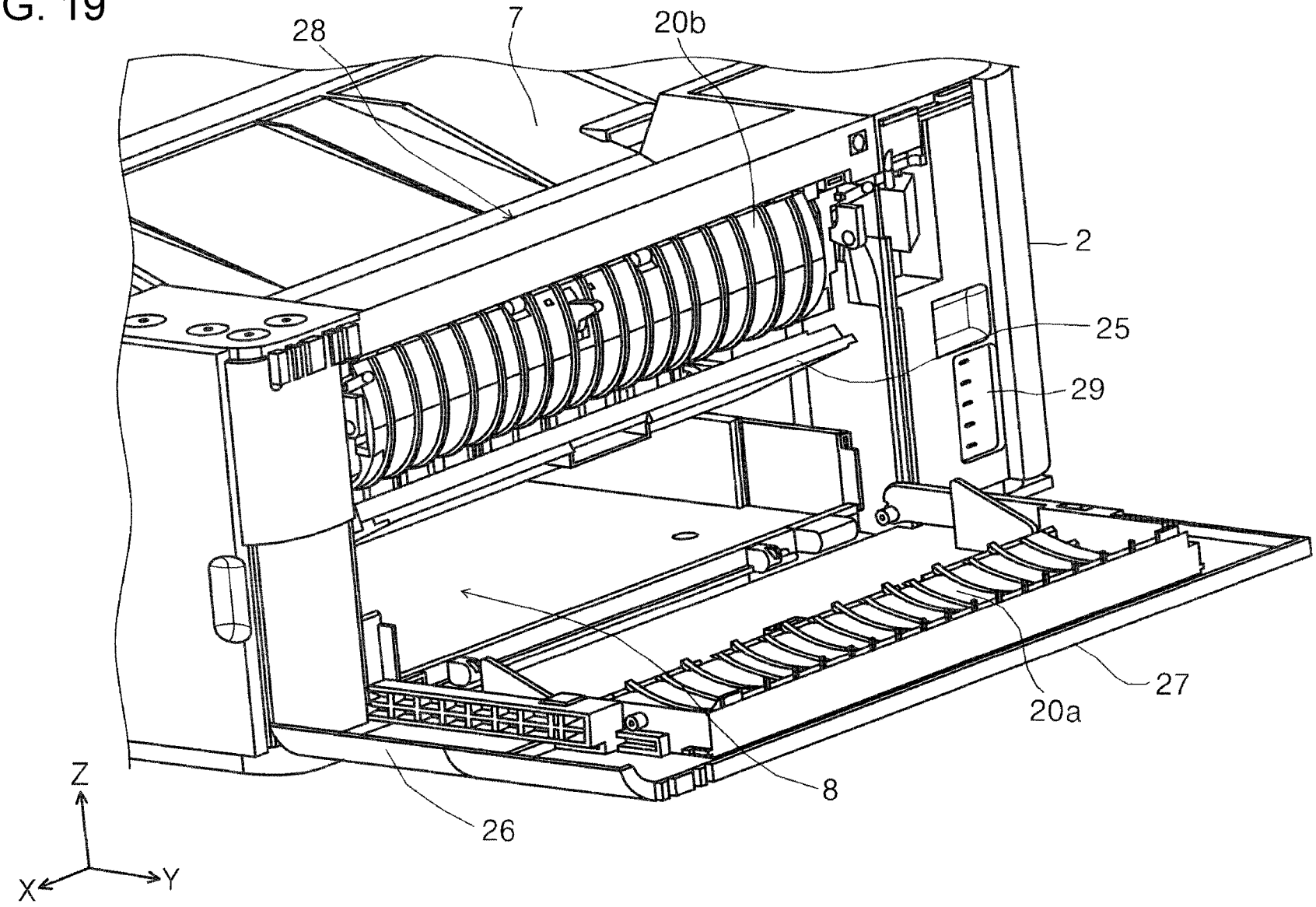
FIG. 19 is a perspective view illustrating a state in which a second cover and the first cover are opened integrally and in which the inversion path is exposed.

As described above, since the inversion path T2 is curved, jamming of the medium P tends to occur more easily in the inversion path T2 than in the straight path T3. In FIG. 1, a second cover 27 is provided above the first cover 26, and the second cover 27 can be opened integrally with the first cover 26. When the second cover 27 and the first cover 26 are opened, as shown in FIG. 19, the outer bend portion 20*a* and the inner bend portion 20*b* are exposed, and processing such as removal of the jammed sheet in the inversion path T2 can be performed. In FIG. 19, the switching member 25 is in the same second state as in FIG. 3.

When jamming of the medium P occurs in the inversion path T2, the control unit 55 performs the third control of switching the switching member 25 to the first state. By so doing, the upstream of the inversion path T2 is further exposed and the removal of the sheet jamming that has occurred in the inversion path T2 can be performed in a further easier manner.

Note that while the disclosure is described as a printer in the exemplary embodiments, the disclosure can be applied to a scanner in a similar manner.

Furthermore, the disclosure is not limited to the exemplary embodiments described above and may be modified in various ways that is within the scope of the claims. It goes without saying that the modifications are also included in the scope of the disclosure.

What is claimed is:

1. A medium transporting apparatus comprising:

a first transport path that outputs a medium that has been processed in a processing unit in which processing of the medium is performed;

a second transport path that outputs the medium processed in the processing unit to an output destination that is different from an output destination of the first transport path;

a switching member that is provided downstream of the processing unit in a medium transport direction and that is configured to switch between a first state in which the switching member constitutes a portion of a path surface of the first transport path, and a second state in which the switching member constitutes a portion of a path surface of the second transport path;

a drive source that drives a transport unit that transports the medium; and a switching mechanism that switches the switching member between the first state and the second state with motive power of the drive source, wherein by switching between the first state and the second state, switching between the first transport path and the second transport path is performed.

2. The medium transporting apparatus according to claim 1, further comprising:

a carriage including the processing unit, the carriage being configured to move in a width direction intersecting the medium transport direction, wherein the switching between the first state and the second state performed with the switching mechanism is configured to be switched by setting the switching mechanism to a transmitting state in which the motive power is transmitted to the switching member and to a non-transmitting state in which the motive power is not transmitted to the switching member, and the switching of the switching mechanism between the transmitting state and the non-transmitting state is performed by a moving operation of the carriage.

3. The medium transporting apparatus according to claim 2, wherein the switching member includes a pivot shaft in a portion upstream thereof in the medium transport direction, and swings a portion downstream thereof as a free end to switch between the first state and the second state, the transport unit is a pair of transport rollers that are provided downstream of the processing unit and that include a driving roller that is rotationally driven by the motive power of the of the drive source and a driven roller that is rotated and driven by a rotation of the driving roller, the switching mechanism includes a first gear provided coaxially with a rotation shaft of the driving roller, a second gear provided coaxially with the pivot shaft of the switching member, and at least one intermediate gear that transmits the motive power from the first gear to the second gear, and the first gear is configured to move in the width direction between a first position in which the first gear meshes with the intermediate gear and sets the switching mechanism to the transmitting state, and a second position in which the first gear separates from the intermediate gear and sets the switching mechanism to the non-transmitting state.

4. The medium transporting apparatus according to claim 3, wherein the switching mechanism includes, a pressing unit that presses the first gear from the first position towards the second position, and an abutment portion that is provided coaxially with a rotation shaft of the first gear and that is configured to be displaced between an advanced position in which the abutment portion is advanced into a movement area of the carriage, and a retracted position in which the abutment portion is retracted from the movement area of the carriage, in a state in which the carriage is in contact with the abutment portion in the advanced position, when the carriage is moved in a direction separating from a home position, the first gear moves from the second position to the first position, and in a state in which the carriage is in contact with the abutment portion in the advanced position, when the carriage moves in a direction approaching the home position, the first gear moves from the first position to the second position.

5. The medium transporting apparatus according to claim 3, wherein the intermediate gear includes a friction clutch mechanism that idles when a torque exceeding a predetermined value is applied.

6. The medium transporting apparatus according to claim 1, wherein the first transport path is a non-inversion path that outputs the medium without inverting a bearing of the first surface that opposes the processing unit, and the second transport path is an inversion path that outputs the medium after inverting the bearing of the first surface.

7. The medium transporting apparatus according to claim 1, further comprising:

a housing inside of which the processing unit is provided; and an opening/closing body provided in the housing, the opening/closing body configured to switch between a closed state that covers a first output unit that is an outlet of the medium transported through the first transport path, and an open state in which the first output unit is exposed with respect to the closed state; and an interlocking mechanism configured to switch the opening/closing body from the closed state to the open state in conjunction with the switching of the switching member from the second state to the first state.

8. The medium transporting apparatus according to claim 1, further comprising:

a detection unit that detects a state of the switching member.

9. A recording apparatus comprising:

a recording unit that performs a recording process on the medium; and the medium transporting apparatus according to claim 1, the medium transporting apparatus transporting the medium processed in the recording unit serving as the processing unit.

10. The recording apparatus according to claim 9, further comprising:

a control unit that controls a state switching operation of the switching member, wherein the control unit switches a state of the switching member according to a type or a size of the medium that is to be transported.

11. The recording apparatus according to claim 9, further comprising:

a control unit that controls a state switching operation of the switching member, wherein the recording unit is configured to perform recording by ejecting liquid on the medium, and the control unit switches a state of the switching member according to a liquid ejection volume per unit area on the medium ejected by the recording unit.

12. The recording apparatus according to claim 9, further comprising:

a control unit that controls a state switching operation of the switching member, wherein in the first state, the switching member is configured to expose a portion of the second transport path, and when a jamming of the medium occurs in the second transport path, the control unit sets the switching member to the first state.

* * * * *